US006105525A

United States Patent [19]

Rapeli

[11] Patent Number: 6,105,525

[45] Date of Patent: Aug. 22, 2000

[54] UNIT CARGO SHIP

[76] Inventor: Pekka Rapeli, Martinlaaksontie 42 D 16, FIN-01820 Vantaa, Finland

[21] Appl. No.: 09/019,672

[22] Filed: Feb. 5, 1998

Related U.S. Application Data

[63] Continuation-in-part of application No. 08/495,505, Oct. 4, 1995, abandoned.

[51] Int. Cl.[7] ..... B63B 25/00

[52] U.S. Cl. ..... 114/72; 114/75

[58] Field of Search ..... 114/72, 73, 75, 114/76, 78, 85

[56] References Cited

U.S. PATENT DOCUMENTS

| | | | |
|---|---|---|---|
| 2,919,662 | 1/1960 | Tobin | 114/75 |
| 3,363,597 | 1/1968 | Zeien . | |
| 3,552,345 | 1/1971 | Harlander . | |
| 3,583,350 | 6/1971 | Goldman | 114/72 |
| 3,738,302 | 6/1973 | Flajole . | |
| 4,012,422 | 3/1977 | Falensky . | |
| 4,043,285 | 8/1977 | Nordstrom . | |
| 4,884,521 | 12/1989 | Belinsky . | |

FOREIGN PATENT DOCUMENTS

| | | | |
|---|---|---|---|
| 0 528185A1 | 7/1992 | European Pat. Off. . | |
| 1319831 | 12/1963 | France | 114/72 |
| 1 178 733 | 9/1964 | Germany . | |
| 1 756 073 | 3/1970 | Germany . | |
| 2900725 | 7/1979 | Germany | 114/72 |
| 108390 | 8/1979 | Japan . | |
| 94885 | 7/1980 | Japan . | |
| 41286 | 3/1982 | Japan . | |
| 163086 | 7/1986 | Japan . | |
| P265608 | of 0000 | Poland . | |
| 364012 | 2/1974 | Sweden . | |
| 806098 | 12/1958 | United Kingdom | 114/72 |

OTHER PUBLICATIONS

Concise English–language translation of German–language Patent Document 1 178 733.

Concise English–language translation of German–language Patent Document 1 756 073.

Concise English–language translation of Swedish–language Patent Document 364012.

*Primary Examiner*—Ed Swinehart

*Attorney, Agent, or Firm*—Klarquist Sparkman Campbell Leigh & Whinston, LLP

[57] ABSTRACT

A cargo ship for transporting wheeled vehicles and cargo units simultaneously has a hull with a bottom structure and a cargo space defined within the hull. The cargo space has at least first and second cargo sections. The first cargo section has a space grillage structure that is self-supporting and flexibly mounted to the hull of the ship so as to diminish the transmission of hull deformation loads to the space grillage structure. The second cargo section is located below the first cargo section and has cargo holds for containing heavy-weight cargo to provide ballast for the ship.

39 Claims, 19 Drawing Sheets

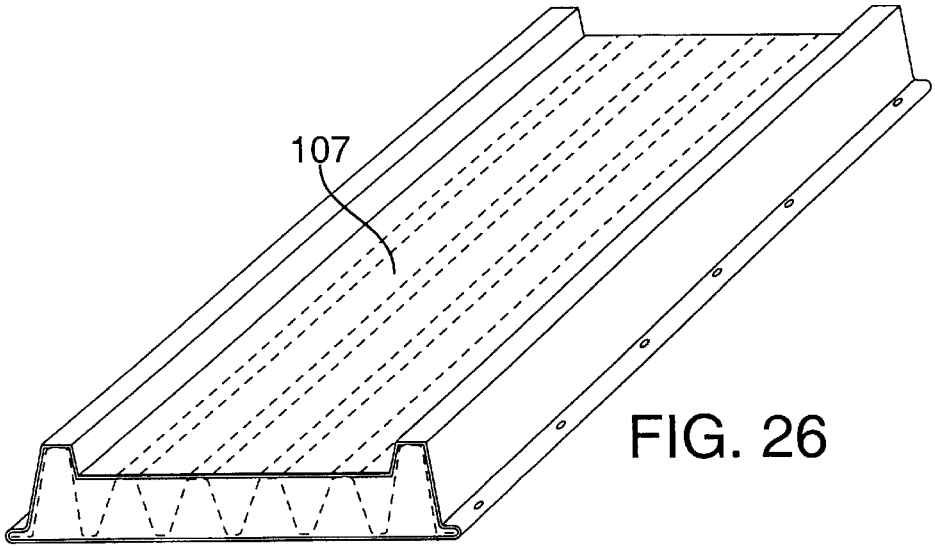
FIG. 26
FIG. 27
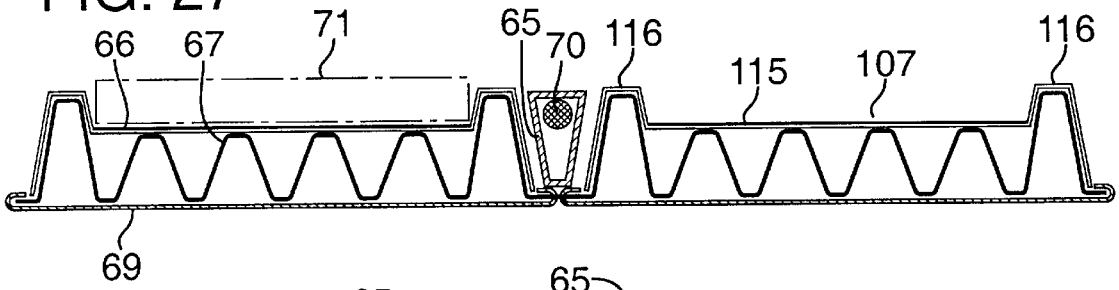
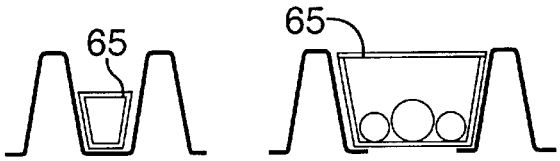
FIG. 28

UNIT CARGO SHIP

This Application is a continuation-in-part Application of Ser. No. 08/495,505, filed Oct. 4, 1995, now abandoned.

FIELD OF THE INVENTION

The present invention relates to a cargo ship for transporting various wheeled vehicles, such as cars, train units and other carriages, and furthermore, bulk goods or containers and palletized general goods or equivalent cargo units, at least partly at the same time, said ship comprising a hull consisting of a bottom structure, the sides and a potential strength deck, which hull, forming a shell structure, mainly bears the forces directed at the ship; the power mechanism of the ship either within or outside the hull; a cargo space, consisting at least partly of a space grillage structure and containing cargo cells; cargo handling openings in the hull for transferring cargo units into the cargo space and out therefrom; and cargo handling equipment with mechanisms for moving cargo units within the cargo space. The invention also relates to a method for erecting and building cargo spaces of the above type in a cargo ship, and a method for transporting cargo units of the types described in the foregoing in a cargo ship of the above type.

BACKGROUND OF THE INVENTION

In the 1960s the volume of vehicle transportation by ship started to expand to the extent that a special ship type was developed for this purpose, the basic concept whereof being still in use. In the beginning, it was for the most part passenger cars and vans that were transported on these ships (PCC—Pure Car Carrier type), on an average, the number thereof being several thousand vehicles (about 2000–4000) at a time. The ships returned empty. In the past few years a multipurpose ship type (PCTC—Pure Car & Truck Carrier with a payload of 4000 . . . >6500 passenger cars) has been gaining ground and in which about 20% of the deck area has been dimensioned to receive heavier wheeled or general cargo. When the heavy-load decks are filled with heavy cargo, the cargo carrying capacity of the remaining light decks is decreased significantly. The free space between heavy-load decks is considerably higher than that of normal car decks.

These special ships usually have 10 to 12 cargo decks, and two of these are mainly reserved for transportation of the above mentioned heavier cargo. The heavy-load decks have to be placed relatively high on the level of the deck above the machinery space if it is located in the afterbody, and thus relatively high, which is not a good solution as regards the stability of the ship.

On the heavy-load decks or on some parts thereof containers may also be placed which have to be brought aboard the ship either on wheeled pallets, in which case the pallets remain on the ship, or by special trucks. The containers are placed in stacks of 1 to 2 layers on the decks.

For functional loading and unloading, space is required for drive lanes, openings in transverse bulkheads, sides and decks. The ship has to be equipped with a heavy stern ramp, stern gates, and in general with 1 to 2 side ports. The transverse bulkheads must be provided with openings, and they have to be specially reinforced and equipped with remote controlled actuators. The cargo decks must have openings and be equipped with hoistable drive-lane ramps, of which some are fixed, some hinged or hoistable. In most cases there are also a few lift platforms of articulated type for handling cargo between two decks. The highest decks can be divided by means of hoistable car decks. There are also car decks which are hinged to the side bulkheads and which can be turned by means of actuators into the operating position. All in all, the structures must have a great number of openings and they must be reinforced, there is a lot of bulky equipment, fixed or moveable, in these areas, and space has to be reserved for drive lanes. There are generally 2 to 3 longitudinal pillar rows on the decks, to reduce the hull weight, but at the same time to create restrictions as to the positioning of vehicles and cargo.

The vehicles are driven within the ship using their own engine power. Because of exhaust gases the ventilation system of the ship must be exceptionally effective. A large number of ventilation ducts also splits the deck areas.

The total weight of vehicle carrying ships is also relatively heavy. The vehicles themselves are homogeneous, light transport goods, the stowage factor being on an average four to five times higher compared with container and general cargo. In a pure car carrier the weight of car cargo represents about 40 to 50% of the dead weight of the ship, while in PCTC-type ships it is only about 20 to 25% of the dead weight. In all circumstances, a considerable quantity of so called ballast water has to be transported to ensure the stability of the ship, in the most unfavourable cases the amount thereof exceeding the weight of the vehicle cargo. As a result, more engine power is needed, unnecessary fuel is consumed; besides, the shipping company does not gain anything from transporting "dead water ballast". The deck houses are located on the uppermost deck, and so are the life-boat stations.

The vertical center of gravity of the ship structure being high has been a limiting factor in utilizing the space vertically. In conventional techniques the construction design in the cargo spaces is based on steel plate deck reinforced with stiffening girders. The total thickness of such a local construction may be 200 . . . >450 mm and the plate thicknesses of fixed light-weight car decks are 5 to 6 mm at the minimum, exceeding considerably the local-strength thickness required by the cargo. In a plate field of a deck there are lower beams in each frame space and high frame girders at sparser intervals. On the edges of deck openings and drive ramps there are high, strong stiffening beams. Hoistable or turnable platforms are of lighter construction, shipyard specific, and constructed in accordance with generally known concepts. Said structures also require space either in the roof or on the walls; in addition, actuators need space.

Vehicle transport logistics is going through changes worldwide. Major producers have established and keep on establishing factories in their main export countries, to be in close proximity to end-users. The seasonal character of transports is growing and vehicle transport volumes are decreasing. Car parts and components are transported in increasing quantities. The freer market places demands on greater flexibility in handling different bulk or general cargo, better suitability for handling port and customer-specific small batches etc. on the ships of tomorrow. Economical use of ships calls for a better transport efficiency also during the return voyage. This is often a problem in current ship types. Loading and unloading no longer takes place in only two ports; on the contrary, a ship may have to make 5 to 10 port calls. The current ship types also have weaknesses in loading flexibility. Placing different kinds of customer-specific batches of different sizes on a number of fixed decks and partly on hoistable decks or drive ramps prolongs the loading phase and does not always succeed satisfactorily. The control of batches to be unloaded at a particular port may also lead to new intermediate loadings there. These problems are hard to eliminate using the current basic concept. Such ship types exert global sea traffic on all sea routes.

RO—RO ships have also been developed to handle multicargoes, whereby they are enabled to transport different vehicles as a part of the cargo. In these ship types the cargo is transferred aboard by means of waggon and carriage pallets, which are carried along with the cargo to the port of destination. This method is applied particularly to transporting forest products. To increase loading flexibility, containers are also loaded on these pallets. Straddle carriers and trucks are also used for container handling. A high cargo space can be divided vertically in two or three sections by means of so-called hoistable car decks. The loading and unloading capacity of the ship is satisfactory. All in all, this method is, however, expensive on account of terminal facilities and special ship equipment. Space utilization and stowage efficiency are not good. To facilitate firm fastening of wheeled cargo, the fixed structures of a ship have to be appropriately constructed; separate fastening equipment and plenty of manual work aboard are also needed. The basic decks of the ships are dimensioned for shaft and wheel loads of heavy wheeled cargo, whereby the local strength of the decks is on an average 8 to 20 times higher than is required by a load of passenger cars and vans.

Refrigerated ships form the third significant ship group carrying vehicle cargo, but only as return cargo. In the refrigerated ships cargo is placed on cargo decks in accordance with conventional technique. The cargo is hoisted onto the decks through hatches.

According to U.S. Pat. No. 1,815,687, cars are transported in a cargo ship provided with fixed or adjustable cargo decks. The cars are transferred onto the decks along ramps.

The patent GB 2 406 105 describes a bulk-cargo ship that is convertible into a car carrier. The ship is equipped with a set of adjustable tween decks; the decks are joined together with ramp units. Cars are driven along a ramp between the quay and the ship aboard the ship and into a parking space on an appropriate deck.

Swedish patent SE 345 632 describes a ship carrying car or general cargo on container-dimensioned pallets with support pillars at the corners. The pallets are hoisted from above into wells on the ship just as is done with containers. Support pillars are arranged to support the pallet thereabove. As car lengths vary considerably, cars have to be placed on unnecessarily long pallets of a standard container's length also in this case.

Swedish patent application SE 8304984-1 describes a cargo ship with movable frame structures mounted on the uppermost deck and with deck pontoon elements related thereto. Cars are moved from deck to deck by means of movable ramp—bridge structures located between deck elements.

U.S. Pat. No. 4,106,640 describes a method of transferring cars into a ship by using complicated, winding conveyor elements, in which method the car wheels are put directly onto the conveyor and the cars are transferred onto normal cargo decks.

As has been already described in part, a cargo deck known in the art comprises a plate field and beams thereunder. In all ship types described above, a majority of the cargo decks have been designed, in addition to serve local loads, to carry loadings required by the total strength of the ship. Normally, the thicknesses of the deck plates, in light-weight decks, are at least 5 to 6 mm. The deck plate thickness for heavier shaft loads is 15 to 16 mm. If only the requirements set by the local strength and the loading demands required by conventional cargo were emphasized, a significantly less heavy and less high structure would be sufficient. The total thickness of the deck structures known in the art is of the order of magnitude 200 . . . >450 mm.

In U.S. Pat. No. 3,363,597, a hull structure of a ship is described which comprises a bottom, the sides and a strength deck. The structural parts constitute a uniform shell structure mainly bearing the forces directed at the ship. Thus, the self-supporting shell constitutes the bearing parts of the ship. A space grillage structure has been positioned within the inner parts of the ship, said structure being mounted, for instance, by welding on said bearing shell structure, and in the cells of said space grillage the actual cargo space units or modules are positioned, being uniform space units. Thus, the question is of how to apply a generally known modular structure in a ship. The design described therein is not any more appropriate for the transportation tasks dealt with above than are the rest of the prior art structures as they result in a conventional cargo ship as regards the cargo space arrangements. The design described therein is not at all appropriate for large-scale transportation of cars etc., or at least the payload efficiency is extremely poor.

SUMMARY OF THE INVENTION

The object of the present invention is a cargo ship which is particularly appropriate for simultaneous transportation of wheeled vehicles, such as vehicles, train units or equivalent, as well as of palletized general goods, containers and/or bulk goods in ratios required each time. The aim is to utilize maximally the ship-specific payload capacity by increasing the limited capacity of the current designs. The enhancement of the cargo intake capacity should concern the increase of both the stowage factor and the increase of the cargo proportion in proportion to the dead weight of the ship. The ship should be capable of handling material in large batches, but also the loading and unloading of the port and customer-specific batches is expected to be flexible, efficient and avoid unnecessary work steps. The above-mentioned requirement concerning cargo flexibility also allows an effective payload to be taken for the return voyage, as well as loading both lighter and heavier cargo. The aim is furthermore to place heavier cargo closer to the bottom level of the ship, whereby firstly, the amount of the dead weight needed, such as ballast water, as an entity can be minimized, and secondly, the stability of the ship can be improved.

The second aim of the invention is to create a new method of building and assembling cargo spaces, said measures having an effect on shortening the building time per ship. The aim is also to devise a building method and a construction that allows the weight of cargo spaces to be decreased essentially and at the same time enable utilization of the space more effectively, particularly in the vertical direction.

The third main objective is to create conditions for more extensive mechanization and automation of the loading and unloading phases. Therewith the handling effectiveness can be increased and the ships port stays shortened.

The invention is described below in detail, referring to the accompanying drawings.

BRIEF DESCRIPTION OF THE DRAWINGS

FIG. 26 shows a corrugated core floor element for loading in axonometric view.

FIG. 27 shows a parallel mounting of two corrugated core floor elements.

FIG. 28 shows three usages of a filling profile used in parallel mounting.

DESCRIPTION OF THE PREFERRED EMBODIMENTS

Figure 22:
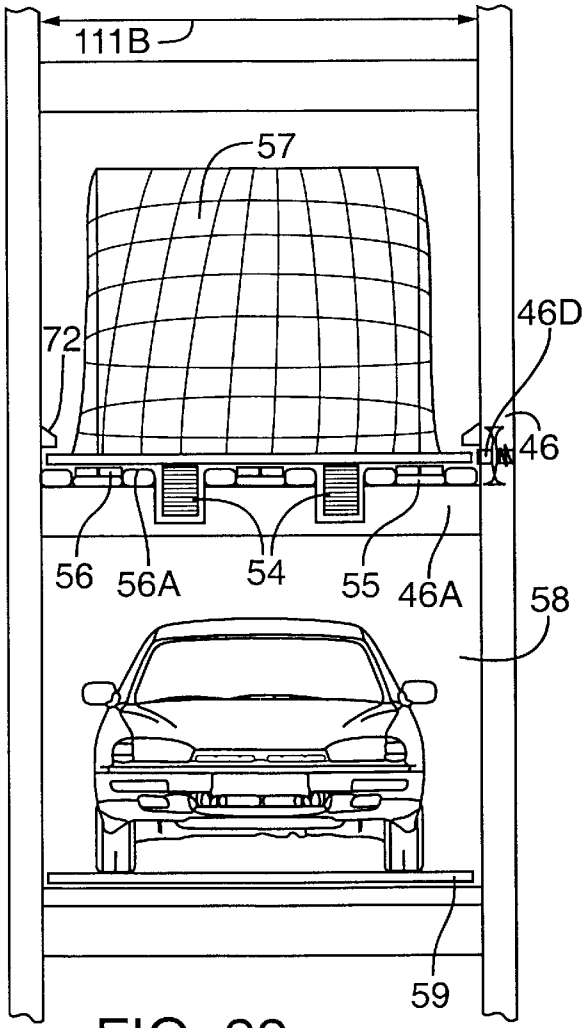
FIG. 22 shows a "fragmentary enlargement" of a cargo cell of the invention in end view, with cargo pallet and a passenger car in place.

A ship according to the present invention comprises one or more such cargo space sections 4,5,6, 10C, (see FIG. 1) frequently mainly concentrated in the middle parts of the ship, the frame of the cargo space whereof has been constructed from a self-supporting space grillage with which the conventional deck plate design provided with beams is replaced. Another feature related to the general arrangement concerns the container holds 7 (FIG. 2) located on the sides of the ship. The cargo space sections 4,5,6, 10C intended for conveying lightweight volume cargo and being made with a space grillage structure is in each case built as high as possible for gaining volumetric advantage. Said cargo space of space grillage structure can be located in the middle part of the ship, the breadth thereof 101 (FIG. 2) being less than the breadth 104 (FIG. 4) of the ship, so that the container holds 7 are located on each side thereof adjacent to the sides 3 of the ship, as shown in FIG. 2. The container holds may also be located in the middle of the ship, whereby the cargo space of space grillage structure is located in the proximity of the sides 3 of ship in order to guarantee access to the container hold preferably from above. Also in said case, the breadth 101 of a cargo space of space grillage structure is smaller than the breadth 104 of the ship. The breadth 101 of the cargo space and the breadth 104 of the ship may be equal, as in fact, is the case in FIG. 3 where the combined breadth of three cargo spaces 6 and 10 is equivalent to the breadth of the ship. The cargo space of space grillage structure extends preferably above the bearing side height 102, as shown in FIG. 4. The vertical center of gravity of the cargo can be lowered significantly, thanks to a heavy container cargo 100 placed in the container holds, and in addition, heavier general goods cargo can be positioned in the lowermost cargo cells 110A (FIG. 6), or transport spaces for bulk goods can be arranged in the lower parts of the ship. By such, total arrangement flexibility is achieved for loading. It allows simultaneously intake of an approximately equal container load and palletized cargo as the weight of car cargo in all, thus omitting useless dead weight. The novel structural principle and general arrangement makes particular use of the lightness typical of a car load with the aid of a cargo space of the novel type, favouring such lightness, so that such ship type is obtained which is appropriate to transport flexibly cars 58 as mass transportation in upper cargo cells 110B (FIG. 9), and at the same time, also to carry containers 100 and palletized general cargo 57, as shown in FIG. 22. The containers and palletized general goods cargo, as well as potential bulk goods represent a heavier type of cargo, and when positioned in the lower parts 38C (FIG. 9) of the cargo spaces of the ship, they create an essential effect of enhancing the stability of the ship. The cargo cells 110 are defined by the horizontally spaced rows of vertical pillars 45 and the vertically spaced cargo platforms 108 and the horizontal beams supporting the same, the cargo cells each thus being generally tubular.

Figure 13:
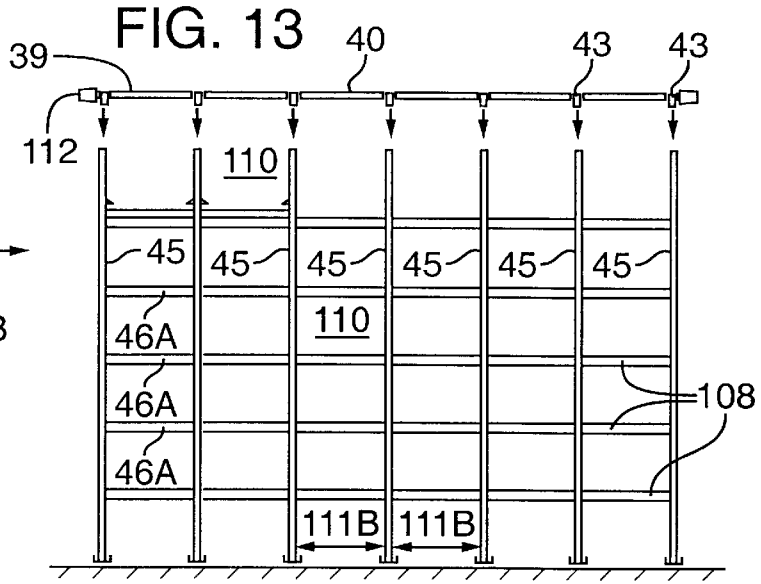
FIG. 13 shows a cross-section of the main module of FIG. 12.

In addition, by the use of specific long cargo cells 110, as shown in FIG. 13, possibilities are created for using highly advanced transfer automation in handling cargo and compact packaging or positioning of cargo units onto cargo platforms 108. By spreading the cargo into numerous cargo tubes, natural sorting of freight by customers, ports and product types becomes possible. The physical location of cargo can be accurately identified with location coordinates, wherewith the utilization of data processing in stability control and chartering follow-up is facilitated. The great length of the cargo cells, maximally approaching the length of the ship, enables in turn that no empty locations are left in the loading, instead, the filling-up degree will be high.

The present invention helps to decrease the weight of a cargo space by replacing the heavy-weight conventional local structure with a lighter space grillage structure 4,5,6, 10C, and the loading platforms 55, 107 (FIG. 12) can be manufactured from light but strong corrugated core or sandwich plates, or they are provided with another light construction 56A. Lighter industrially prefabricated products can be used as equipment. The total savings in weight are dependent on the basic structures of the ship in the surroundings of the cargo spaces. The construction makes it possible to minimize the height H of a single cargo stock unit, the effect whereof being multiplied; respectively, it will, together with lighter weight, allow the use of a large number of intermediate cargo platforms vertically in a new cargo space with space grillage structure. As regards the construction, the structure is flexible. The lower cargo cells 110A (FIG. 6); 38C (FIG. 9) can be reinforced, as they fit very well the entire complex, to conform to heavier pallet or vehicle cargo.

Open container holds 7 of known technique, provided with proper guide rails and locking devices for containers 100 are located on both sides of the vehicle-cargo space. The stability and the hull strength permitting, containers may also be loaded above the main deck 28.

Figure 5:
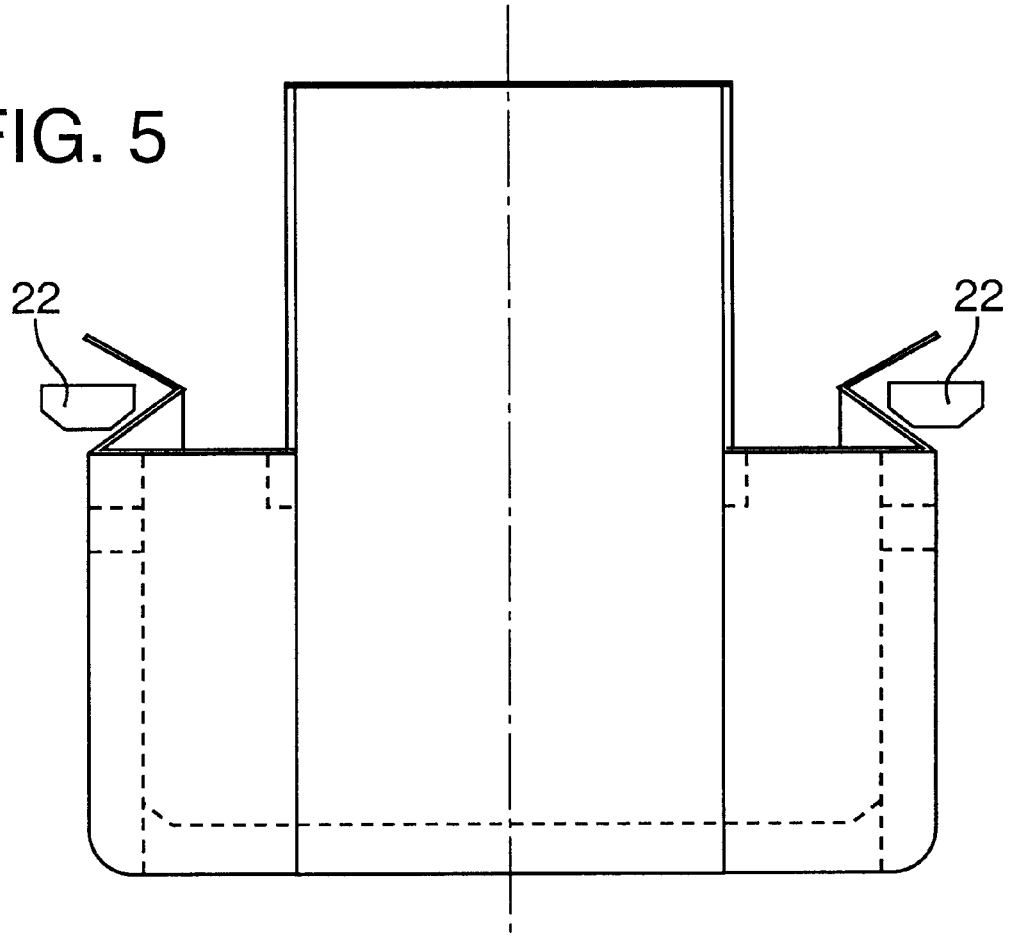
FIG. 5 shows a cross-section of the ship of FIG. 1, behind the bow structure.
Figure 16:
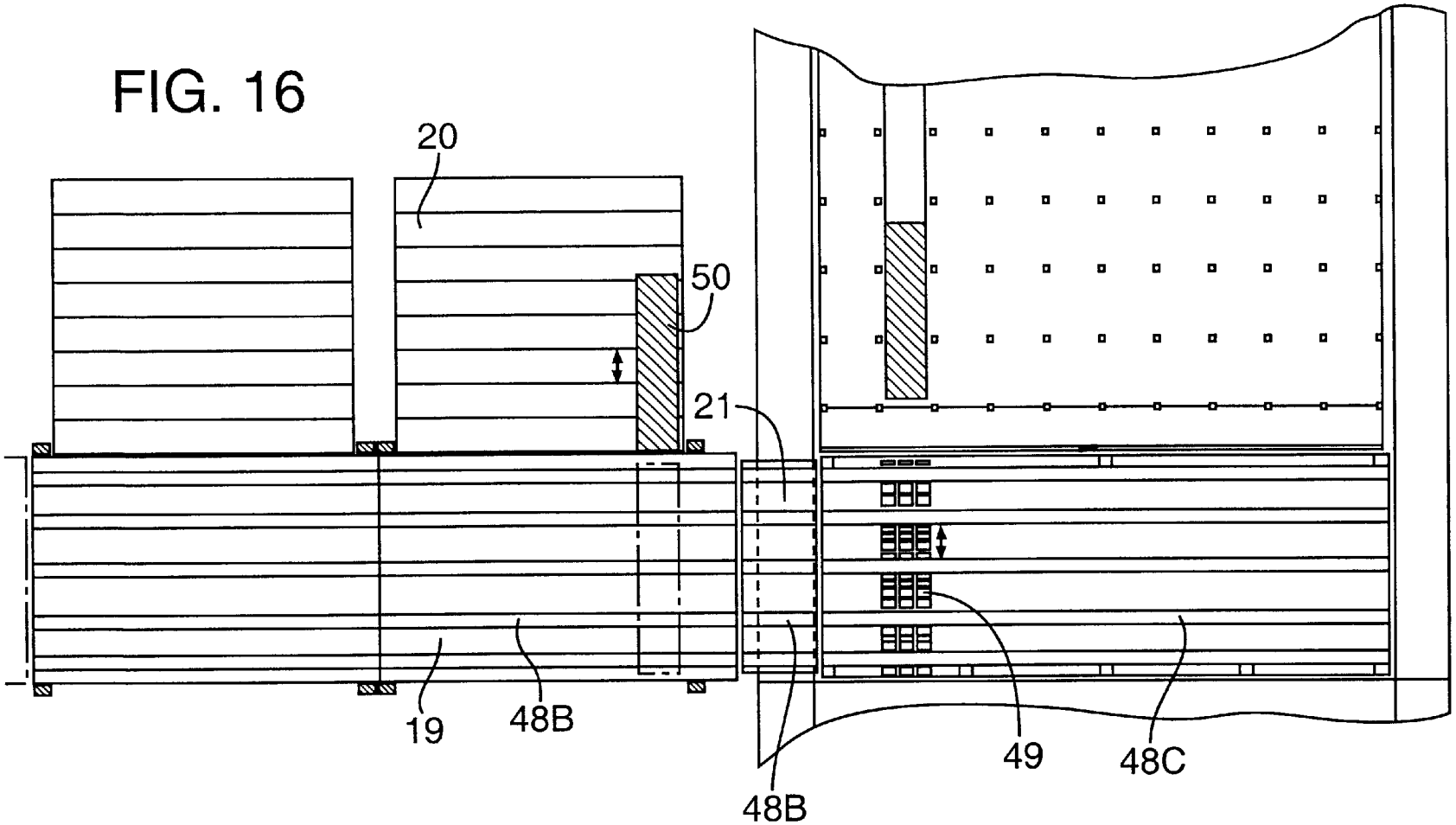
FIG. 16 presents a transfer route of a cargo pallet from a sorting table on the quay onto a lift platform and from there to a cargo cell.

Feeding lanes for vehicle cargo and palletized goods are shown in FIGS. 2, 5, and 16. While creating ship applications, also other alternative applications exist. Advantages gained in loading and unloading times have to be estimated in the designs.

In the middle area, the vehicle cargo spaces may extend from the stern 106 (FIG. 2) up to the forepeak bulkhead. Depending on the transport route, a decision has to be made whether loading from stern alone is sufficient via lift platforms 17 and opening 10A (FIGS. 1 and 2) or whether other lift platform wells 15,16 (FIG. 1) are needed according to the design in some place. The ship's machinery arrangement has a great influence on the optimization of the entire complex.

Figure 12:
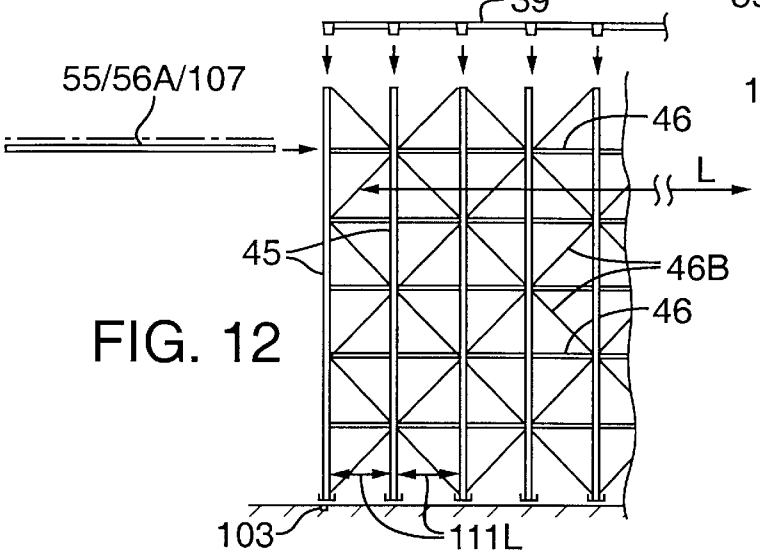
FIG. 12 presents one of the embodiments of the main module in a greater detail as a longitudinal section.

The space grillage structure 4, 5, 6, 10C of the ship comprises industrially produced modulized profiles 45, 46, 46A, as shown in FIGS. 12 and 13, for which different methods of mounting profiles are currently available. The vehicles are of differed heights and breadths. From the outset, a particular combination can be designed, e.g. cars of a certain category are placed in a cargo space. Since a ship is a long-term investment, it is essential that the height H of cargo cells be later adjustable without breaking the complex. To maintain this flexibility, the total length L of a cargo cell has to be designed for certain product lengths and product alternatives, and it is of the length of two, and preferably of five cargo units 58, 57. In a number of instances, it is relevant to arrange the length of a cargo cell to be as long as possible. It is also conceivable that the space grillage structure is arranged to be such that the lengths of all, or some, cargo cells can be varied as need be, even individually for each voyage. It is obvious that the cargo cells can be placed in longitudinal or transverse direction to the ship 1. The use of length-adjustable cargo pallets 59 is essential because a considerable part of the payload potential of a ship is lost with fixed pallet lengths, or if a payload capacity of a given level is desired to be maintained, a considerably longer ship should be built.

The use of car-cargo spaces of space grillage structure brings the greatest efficiency advantage over constructions known in the art through the simultaneous utilization of the advantages of the extra height offered by this construction. In a multi-purpose ship the vehicle cargo spaces of the new type can also be located in intermediate spaces. For example, the lower decks 103,113 (FIG. 3) in the stern part of the ship may be designed for transporting heavier wheeled vehicle cargo, while the upper part 6, 38A, 38B (FIGS. 3 and 9) is used for transporting lighter vehicle cargo.

Figure 6:
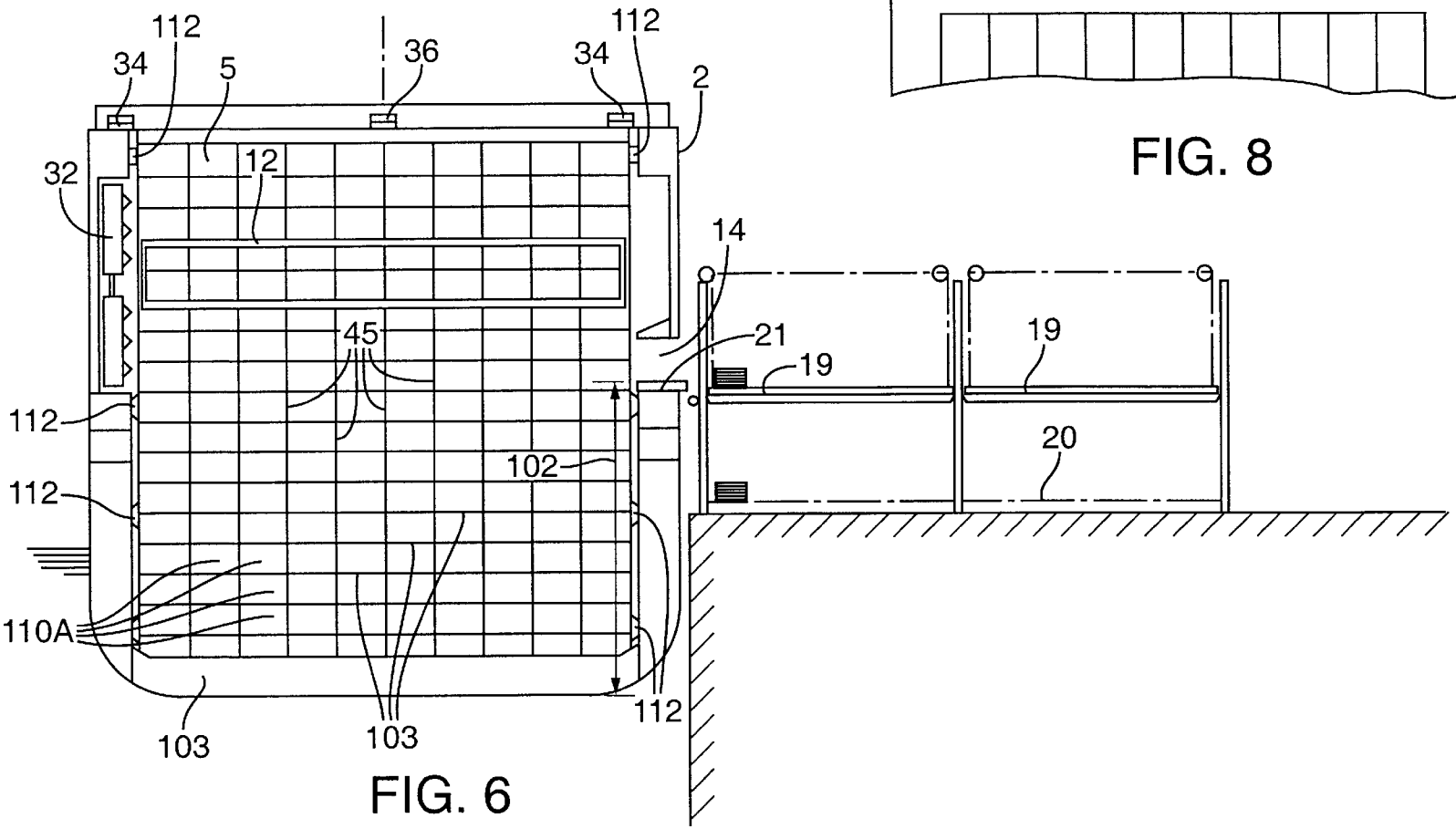
FIG. 6 shows a cross-section of the ship of FIG. 1, illustrating the bowpart cargo space, with the ship positioned adjacent the quay.

FIG. 6 shows an alternative where transverse bulkheads separating vehicle cargo spaces extend vertically only to a part of the side height 102. In this alternative the power units of the lift platform are placed in a bridge beam structure. In certain situations, it is advantageous to use one lift platform for loading/unloading several cargo spaces.

Figure 7A:
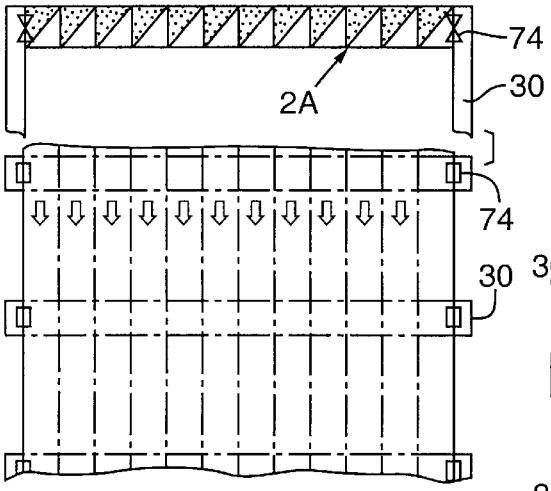
FIG. 7A presents an embodiment of the double roof structure of a space grillage structure according to the invention.
Figure 7B:
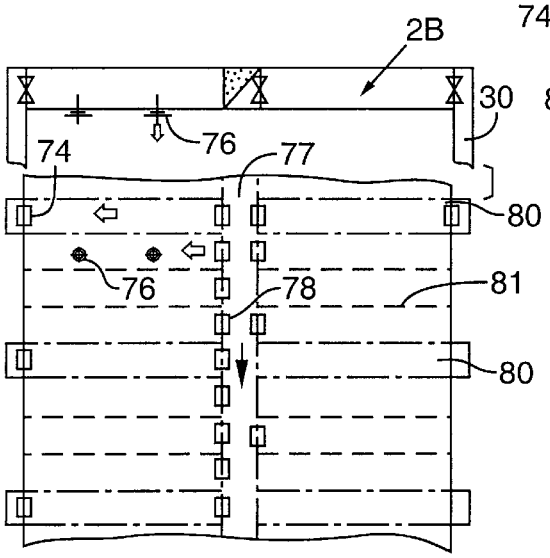
FIG. 7B shows a second embodiment of the double roof structure.
Figure 7C:
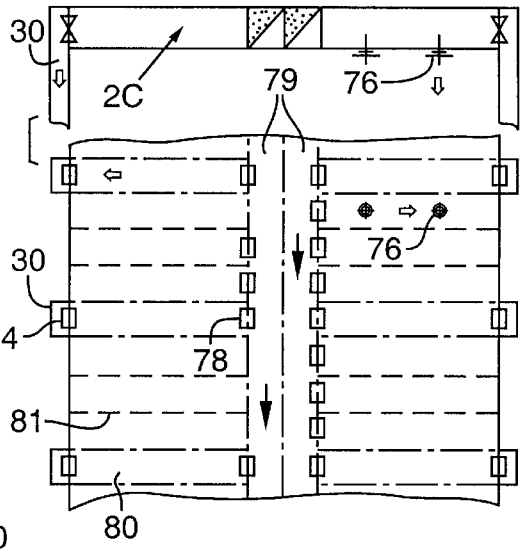
FIG. 7C shows a third embodiment of a double roof structure.

In FIGS. 7A–7C, three embodiments of a double-bulkhead roof 2A–2C, i.e. a homogeneous steel construction, are presented as the roof structure for cargo space 4, 5, 6, 10C. In FIG. 7A, the roof pattern 2A has longitudinal reinforcement but it can also be a transverse construction. Some alternative applications of longitudinal and combined longitudinal-transverse combinations are shown in FIGS. 7A, 7B and 7C, corresponding to channel construction models 2A, 2B and 2C. The present invention is applicable to further alternative construction models as well. As regards the strength technology, advantages are gained therethrough, and at the same time the channels of the roof form a natural ventilation-air duct network in the roof area of the cargo space. These channel networks can be connected to certain separate intermediate spaces 26 (FIG. 17), 32 (FIG. 3), these being a characteristic feature of the present ship type, spaces being intended for air-conditioning and ventilation modules and other equipment. The homogeneous bulkhead 2 (FIG. 2) can also be used as side bulkhead structure of the high cargo space in the middle part, in which way at least part of the frame channels thus produced could function at the same time as a frame for the ventilation ducts 30 or the frame structures of the ventilation ducts could be used as part of the normal vertical framework located either inside or outside the cargo space as shown in FIG. 7A, 7B, 7C.

Ventilation and air-conditioning equipment as well as air drier filters and ducts, all of which require plenty of space, can be concentrated in intermediate spaces of their own in the side 32 or middle 26 (FIGS. 1 and 2) parts of the ship, depending on the main frame type of the ship. The intermediate space in the midship 26 constitutes at the same time a strength element binding the superstructure and connecting the sides of the ship. Heavier equipment may be placed lower and closer to the target areas. It is also possible to utilize the steel structure of the ship as natural frame parts of the channel net, e.g. by using homogeneous constructions in transverse bulkheads 109,105 and by utilizing the spaces in the longitudinal bulkhead 2 e.g. for double-skin spaces 30, 31, 33. The number of channels can be decreased, channels can be moved away from cargo platforms, and the direct effect of primary air-conditioning equipment on the air processing of the space can be increased.

Since the own engine power of the vehicles is used, highly effective ventilation is required in carrier ships. The present invention also enables vehicles to be transferred without engine drive, said feature having a crucial effect on the air-conditioning complex of the ship. The space grillage cell structure is very open in the ends, and the floors 55, 107 of the cargo cell tubes are similarly fairly open. Therewith, and with a minimum number of channels 2A,2B,2C; 30,31,33, an effective flow-through ventilation system covering the whole breadth of the space and extending "from stern to bow" and "from bottom to roof" can be built, which is not quite as clearly possible related to old concepts.

If the character of the cargo so requires, it is also technically easy to equip this kind of cargo-space complex with adjustable air-conditioning or air-drier-filter units. It is possible to use technically effective fire-safety-control and fire-fighting applications in a fairly high and open space like this.

Vehicle cargo can be transferred in place in cargo cells in a number of ways. Using an integrated, highly automated conveyor chain, the cargo has to be placed on a conveyor pallet 59, put onto a sorting table 20 on the quay, as shown in FIG. 16, from which the cargo is automatically transferred by the aid of means applications employing prior art conveyor-technique first onto a lift/transfer platform 20, onto an intermediate platform 21, onto a lift platform and from there into a cargo cell 110.

Vehicles may also be driven by using their own engine power from the quay onto a lift platform and from there on, by driving, into a cargo cell, as was known in the art. Vehicles may also be transferred in transverse position, pushed by conveyor actuating means, without a cargo pallet, directly onto a lift platform and be driven from there into a cargo cell.

Vehicles and general cargo may also be transferred through the opened roof opening of a cargo well 15, 16, for which purpose appropriate lift platforms or multistock, cell-like lift platforms of grillage structure are needed.

Figure 21:
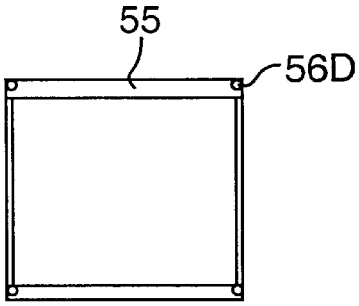
FIG. 21 shows structures of the lift platform of FIG. 20 in side section.
Figure 20:
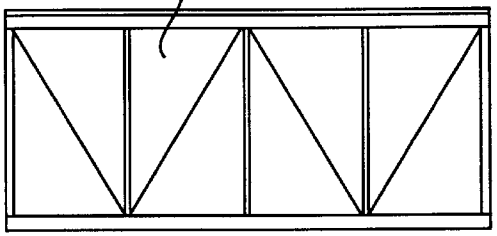
FIG. 20 shows structures of a two-stock lift platform, cross-section.
Figure 17:
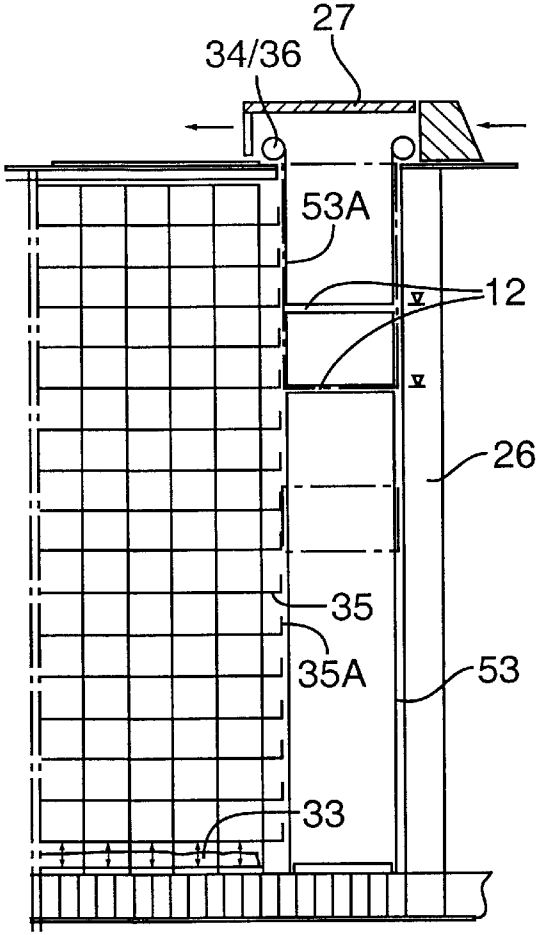
FIG. 17 shows a side view of a cargo well with power units.

A multi-stock lift platform, the platforms of which are bound to each other with a supporting grillage reducing the weight of the entire structure, is principally used in a ship built in accordance with the present invention. FIGS. 20, 21 present a two-stock design of a lift platform. A two-stock lift platform has two platforms that are vertically spaced apart from one another a distance equivalent to the vertical distance between the loading platforms 108 on two cargo cells, as can be seen in FIG. 17. The loading efficiency is substantially increased when more than one cargo cell platform 108 can be loaded or unloaded simultaneously.

Placing accommodation spaces 8 (FIGS. 1 and 2) in the bowpart creates new possibilities in the general arrangement. The high cargo space in the middle part is bound by this construction as well as by a broader afterbody 106 construction. The mass of the accommodation spaces is located lower than in conventional ships. Placing life-boat stations 22 on the upper deck behind the accommodation spaces has a similar effect.

Large ships have double skins 1 with a reinforced torsion resisting boxgirder 28 (FIG. 4) in the upper part, and below that there is often a passage box 29 for internal traffic, cables and channel and pipe lines. It goes without saying that the ship hull also comprises a bottom 103 and the bearing sides 3. These together constitute a self-supporting shell structure.

In the erection phase of a ship, endeavours are made to use as large and as highly outfitted construction complexes as possible with shipyard-prefabricated or otherwise factory-made components. The aim is to remove work away from the chaotic ship environment. The main purpose is to shorten the total building time of the ship significantly and at the same time, to make said work cost-effectively. These goals can be effectively achieved in a highly modulized product with a space grillage structure 4,5,6,10C. Thereby, a product of high quality standard is achieved. With a highly modulized main structure 38, also advantages in service and maintenance are gained. Replacing damaged parts or components takes considerably less time than repairing nonhierarchical or "permanent" constructions made on the site.

The supporting body of the cargo spaces comprises a space grillage structure dimensioned to bear the load of the cargo in the cargo cells 110 and to pay attention to the acceleration forces caused by the heeling of the ship, but it is not designed, as a structure as such, to take part in bearing the intact strength of the ship. Construction technically, the grillage structures are strong and light.

Depending on its size, the space grillage is vertically and horizontally divided so as to comprise at least one main module 38A,38B or 38C (FIG. 9), which forms the main assembly unit during the ship erection phase. At the same time it serves as an internal strength module of the space grillage if there are several main modules. The operating conditions of a ship have to be taken into consideration in ship-technical solutions. In the longitudinal direction, the modules 38 may be up to about 40 m long. On the top horizontal border line, the modules are bound with a separate roof grillage 39, as shown in FIG. 13, as will be explained in greater detail below.

It is principally on the level of the roof grillage 39 where there are mountings between the cargo space and the bow bulkhead 105 (FIG. 1), the stern bulkhead, and the side bulkhead 2 (FIG. 6), or to the side 3 of the hull. These connections are made using flexible connecting elements 112, which are flexible in the sense that they allow at least one of the two components being connected together to move relative to the other.

Figure 32:
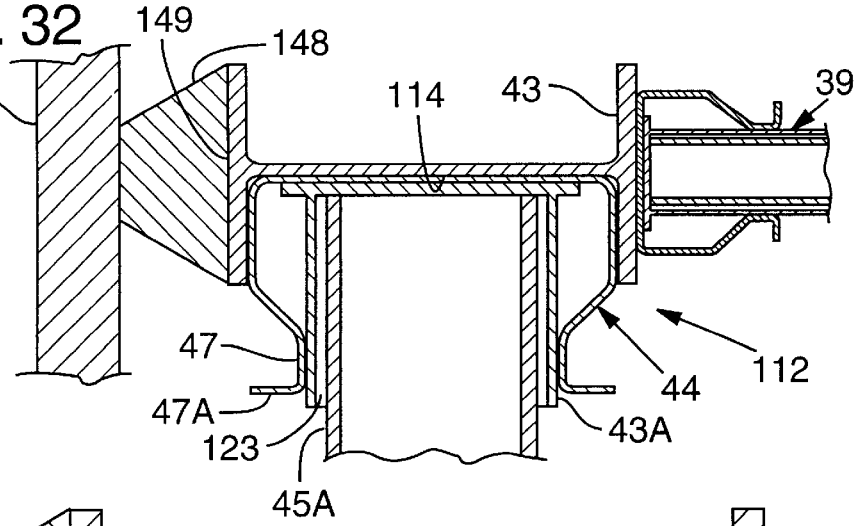
FIG. 32 is a cross-section of a flexible connecting element connecting the grillage to the bulkhead.

A detail of one of the flexible connecting elements 112 is shown in FIG. 32. Each flexible connecting element 112 has an I-beam profile 43 and a specially shaped profile 44 extending downwardly from the bottom surface of the leg 114 of the "I". A sleeve 43A, preferably made of steel, fits into the profile 44. The profile 44 is specially shaped to aid in aligning the sleeve with the I-beam profile 43. In the illustrated embodiment, the profile 44 has a rectangular base, which is wider than the exterior periphery of the sleeve 43A, and which tapers into a neck 47. The neck snugly holds the sleeve 43A in place. A leg 47A extends perpendicularly outward from the bottom of the neck 47.

The sleeve 43A is placed around the exterior periphery of the vertical pillar 45A, which is adjacent the side bulkhead 2. The interior periphery of the sleeve is sized slightly larger than the exterior periphery of the vertical pillar 45A so that when the sleeve is placed around the vertical pillar, there is clearance 123 between the exterior periphery of the vertical pillar 45A and the interior periphery of the sleeve 43A.

Once the flexible connecting element 112 has been placed around the sleeve, a spacer 149 is inserted between the left cross-bar 148 of the "I" and the side bulkhead 2 to fix these components relative to one another. Thus, in this embodiment, the I-beam profile 43, profile 44, and sleeve 43A are immovable relative to the side bulkhead 2. Nevertheless, alternative embodiments in which these elements are movable relative to one another are feasible and will be discussed later.

Even though the I-beam profile 43, profile 44, and sleeve 43A are fixed relative to the bulkhead, and thus to the side 3 of the hull, forces that may occur in the hull, such as those created by deformation due to rough seas, are not transmitted to the roof grillage 39 or space grillage, or at least their transmission is reduced. Instead, the clearance 123 allows the bulkhead or ship hull to move relative to the vertical pillar 45A, and thus to the roof and space grillages.

The flexible connecting elements 112 are also used for making flexible connections between other parts on the ship, such as between the roof grillage 39 and all the other vertical pillars 45, as seen best in FIG. 13. Also, the flexible connecting elements are used to connect the space grillage with the bulkhead or side of the ship, at levels other than the roof grillage level, such as those levels shown in FIGS. 3, 4, and 6. Preferably, flexible connecting elements are positioned at heights of every two to three cargo cells 110, thus approximately every 4.5 meters. At these heights (approximately every 4.5 meters), intermediate grillage structures similar to the roof grillage structure 39 could be used.

Figure 41:
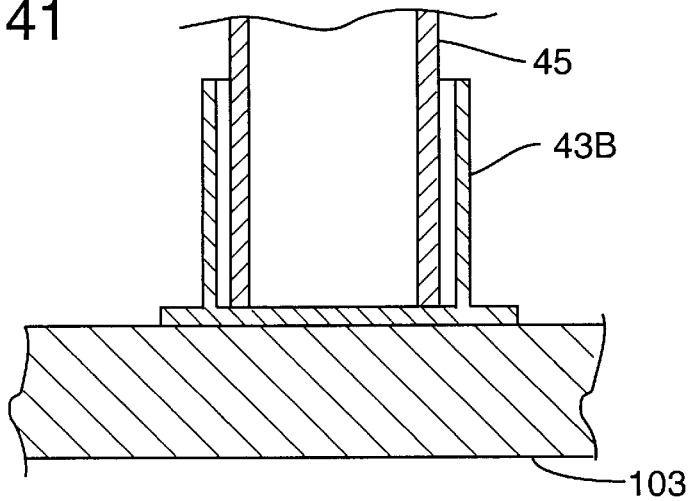
FIG. 41 is a cross-section of a flexible connecting element connecting the grillage to the ship bottom.

The flexible connecting elements also are used for connecting the grillage (at the bottom of the vertical pillars 45) to the bearing floor of the ship, such as the double bottom 103, as shown in FIG. 41, or other deck 113. In this case, the sleeves 43B are welded directly to the double bottom 103 or other deck 113, and there are no profiles. The vertical pillars 45 fit into the sleeves 43B as previously described, and the modules rest upon the double bottom 103 or other deck 113.

Thus, the use of flexible connecting elements 112 to make all connections between the grillage and the ship helps ensure that deformations that may occur in the hull of the ship are not transmitted to the grillage. In this regard, because the connections between the ship hull and the grillage are flexible, the ship hull provides little, if any, structural rigidity to the grillage. Thus, it is essential that the grillage be self-supporting, as described earlier.

Figure 15:
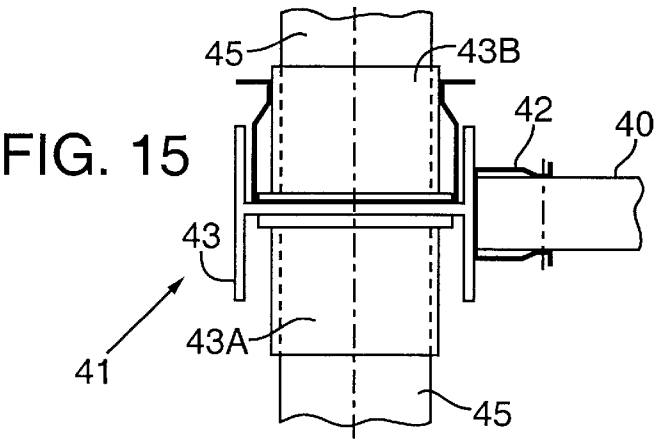
FIG. 15 shows a connection of the vertical profiles of the main modules of FIG. 12 to one another.

Flexible grillage connecting elements 41, which function largely the same as the flexible connecting elements 112, are used to connect separate space grillages 4, 5, 6, 10C, as indicated in FIG. 15. The grillage connecting elements 41 can be used to connect the grillages vertically, as illustrated in FIG. 15, or horizontally. The grillage connecting element has a lower sleeve 43A, and an upper sleeve 43B, fixed to the I-beam profile 43 and extending downwardly and upwardly, respectively, therefrom. The illustrated grillage connecting element 41 is shown with only one specially shaped profile 44, which surrounds the upper sleeve 43B, although a second specially shaped profile could be used in conjunction with the lower sleeve 43A.

The lower sleeve 43A is placed around the top of a vertical pillar 45 of a lower space grillage, and the bottom of a vertical pillar 45 of an upper space grillage rests in the upper sleeve 43B, to thereby bind together the upper and lower space grillages. Additional flexible grillage connecting elements are used wherever the upper and lower space grillages are connected. Both sleeves 43A, 43B have clearance 123 (like that shown in FIG. 32) between the interior of the sleeve and the exterior of the vertical pillar to allow the space grillages to move relative to one another. Such flexible grillage connecting elements 41 can be used between all the space grillages or none of them, depending on how much flexibility is desired.

Figure 33:
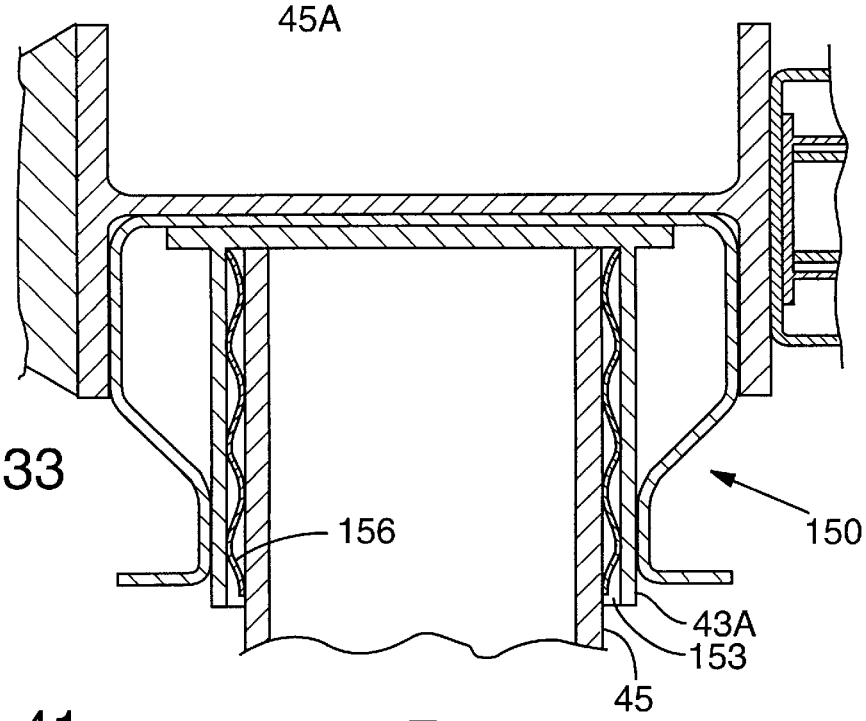
FIG. 33 is a cross-section of an alternative flexible connecting element connecting the grillage to the bulkhead.

Instead of merely having a clearance between the sleeve and the vertical pillar, an alternative flexible connecting element 150, as shown in FIG. 33, could be used. In flexible connecting element 150, the clearance 153 between the sleeve 43A and the vertical pillar 45 is crossed by a resilient member 156, such as a metal spring (for instance, a spiral spring, cup spring, leaf spring, or the like), a rubber spring or a spring of other material.

Figure 34:
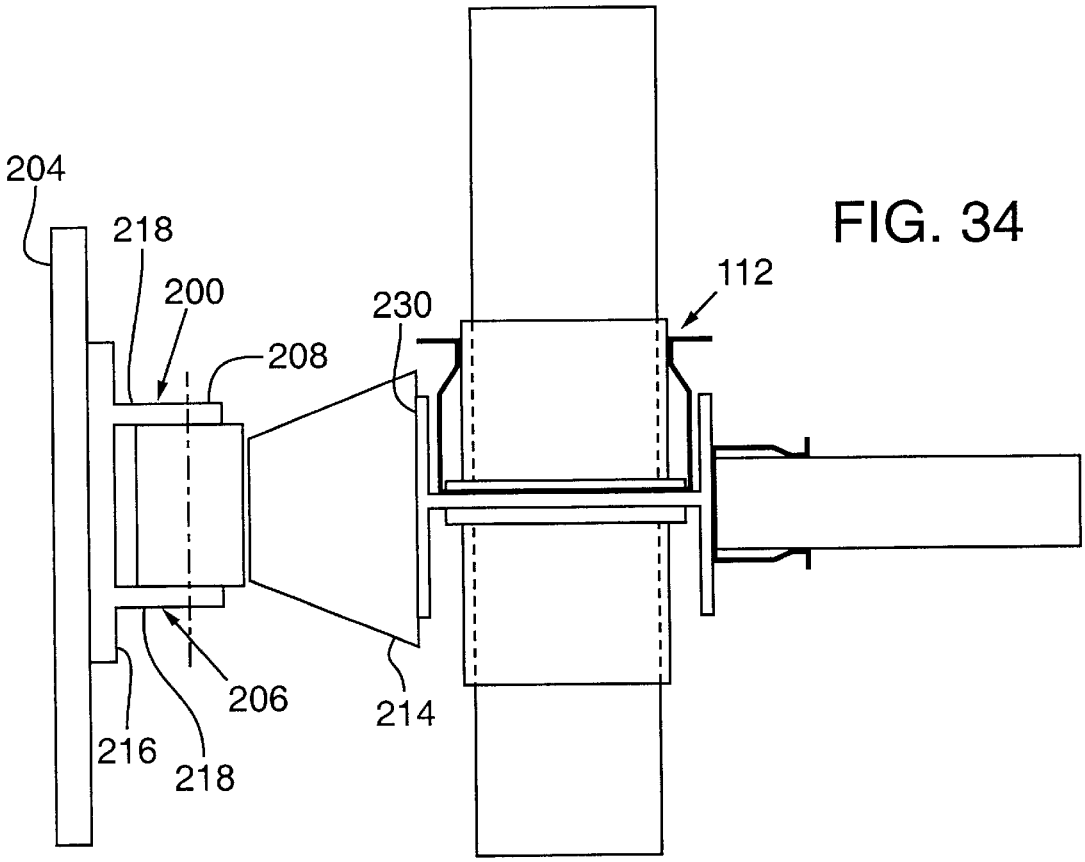
FIG. 34 is a side view of a vertical roller assembly positioned between the flexible connecting element and the bulkhead.
Figure 35:
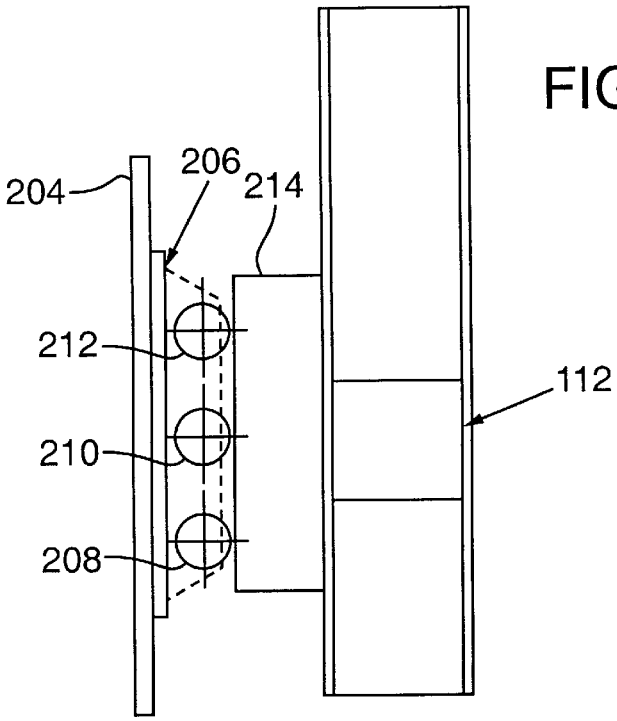
FIG. 35 is a top view of the vertical roller assembly of FIG. 34.

FIGS. 34–39 show alternative constructions for structures between the flexible connecting elements 112 on the space grillage and the ship. As shown in FIGS. 34 and 35, one alternative embodiment has a vertical roller assembly 200 between the flexible connecting element 112 and the bulkhead 204. The vertical roller assembly 200 has a roller holder 206, three rollers 208, 210, 212 attached to the bulkhead, and a box beam structure 214. The roller holder 206 has a back plate 216 with two horizontally oriented plates 218 extending perpendicularly therefrom and vertically spaced apart an amount sufficient to fit the rollers therebetween. The three rollers are held between the plates 218 by means known in the art, such as axle pins (not shown) and are equally spaced apart horizontally. With such a construction, both the roller holder and the rollers are fixed relative to the bulkhead.

The box beam structure 214 is mounted to the exterior side 230 of the I-beam of the flexible connecting element 112 on the grillage structure and extends the length of the three rollers 208, 210, 212. Thus, the box beam structure 214 provides the rollers with a surface to roll upon.

The roller assemblies 200 provide some support to the grillage structure laterally across the ship, while allowing the grillage structure to move fore and aft in response to possible torsional deformation of the hull. Because the grillage structure is not fixed vertically relative to the hull, the grillage structure may also move vertically slightly as the hull deforms.

Figure 36:
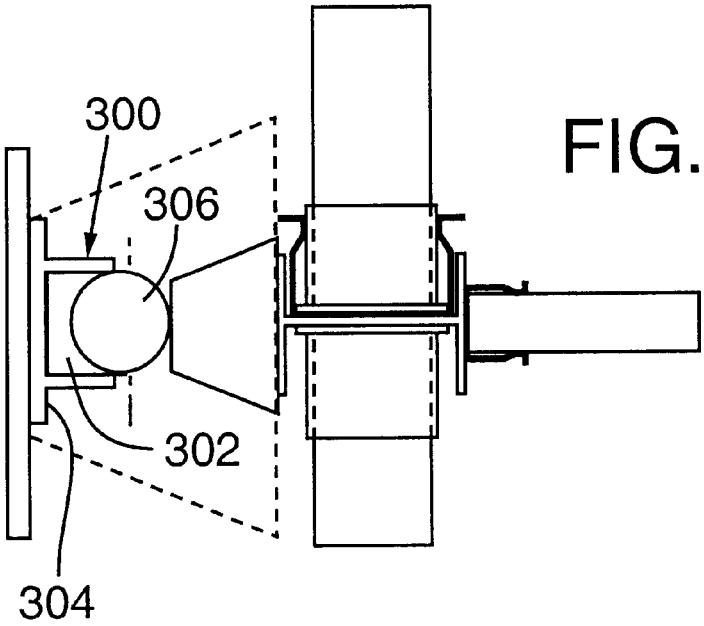
FIG. 36 is a side view of a ball bearing assembly positioned between the flexible connecting element and the bulkhead.
Figure 37:
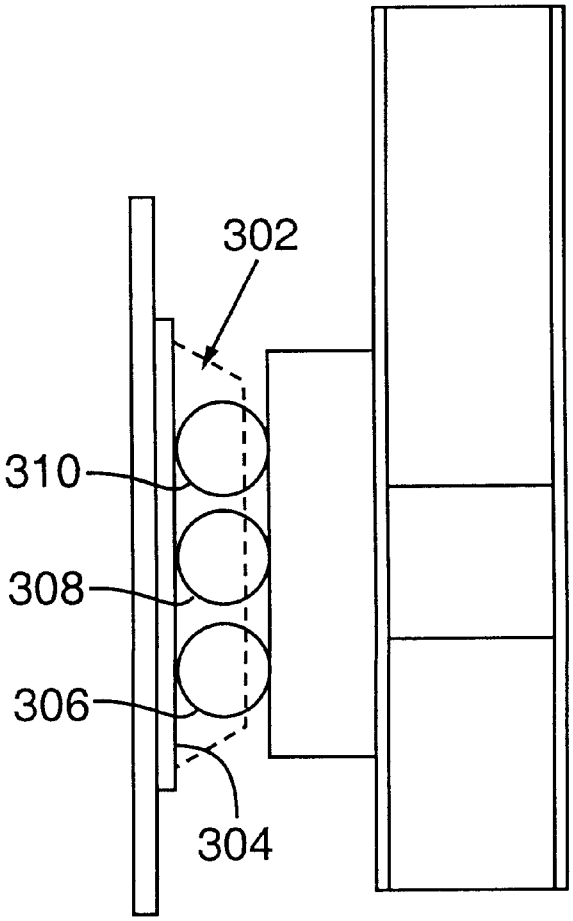
FIG. 37 is a top view of the ball bearing assembly of FIG. 36.

Instead of rollers, a ball bearing assembly 300 could be used, as shown in FIG. 36. The ball bearing assembly 300 would function in much the same way as the roller assembly 200, but would allow easier vertical movement of the grillage structure relative to the hull. Commercially available ball bearing assemblies can be used. In the illustrated embodiment, the ball bearing assembly 300 has a commercially available bearing material 302 between the bearing holder 304 and the bearing balls 306, 308, 310 although a pivotable contact could be used instead.

Figure 38:
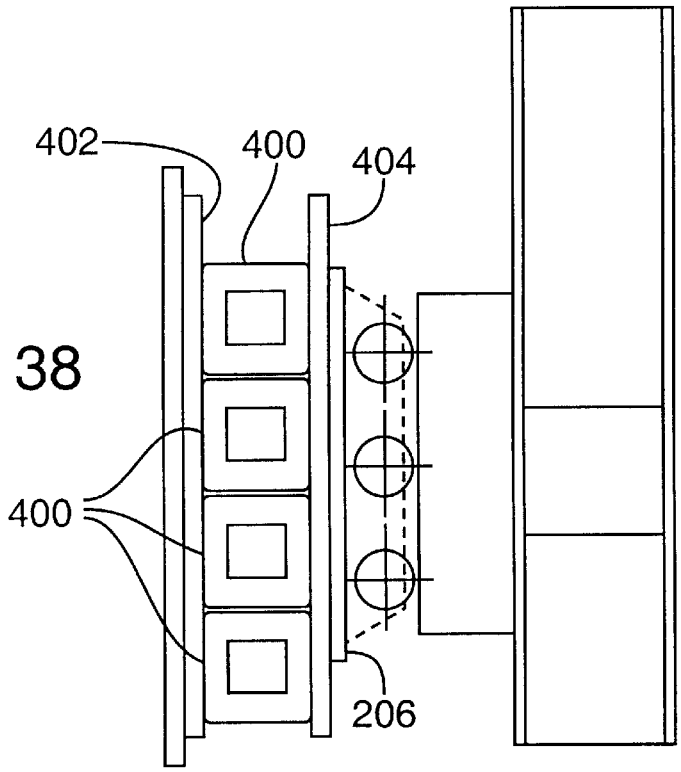
FIG. 38 is a top view of elastic fenders positioned between the vertical roller assembly and the bulkhead.

To provide for greater movement in the lateral direction across the ship, that is, greater movement than is provided by the flexible connecting elements themselves, elastic fenders 400 could be provided between the roller holder 206 and the bulkhead, as shown in FIG. 38. In the illustrated embodiment, there are four elastic fenders 400 of rectangular cross-section sandwiched between an outer plate 402 mounted to the bulkhead and an inner plate 404 mounted to the back of the roller holder 206. The elastic fenders 400 are flexible in the lateral direction and permit vertical movement to some extent. Similar elastic fenders are currently used in piers to dampen the collision impact on ships.

Figure 39:
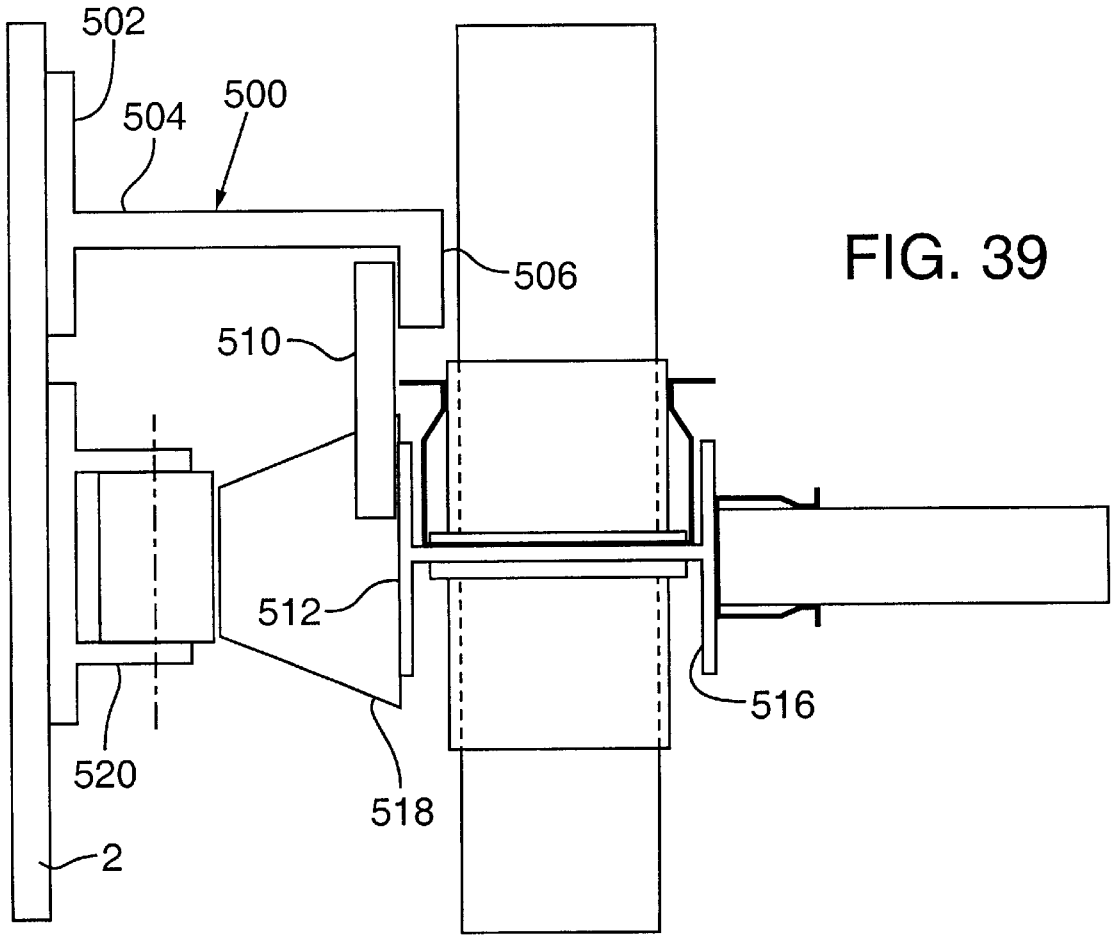
FIG. 39 is a side view of a longitudinal pull support.

Also, as shown in FIG. 39, a longitudinal pull support 500 can be used with the vertical roller assembly. The longitudinal pull support 500 has a back plate 502 fixedly mounted to the bulkhead 2 and a support arm 504 extending perpendicularly outward therefrom. A leg 506 extends downwardly from the end of the support arm 504 to hold in place a plate 510 fixedly mounted to the exterior cross-bar 512 of the I-beam 516. The longitudinal pull support hinders the I-beam 516 and the spacer 518 from moving laterally away from the roller assembly 520.

Figure 40:
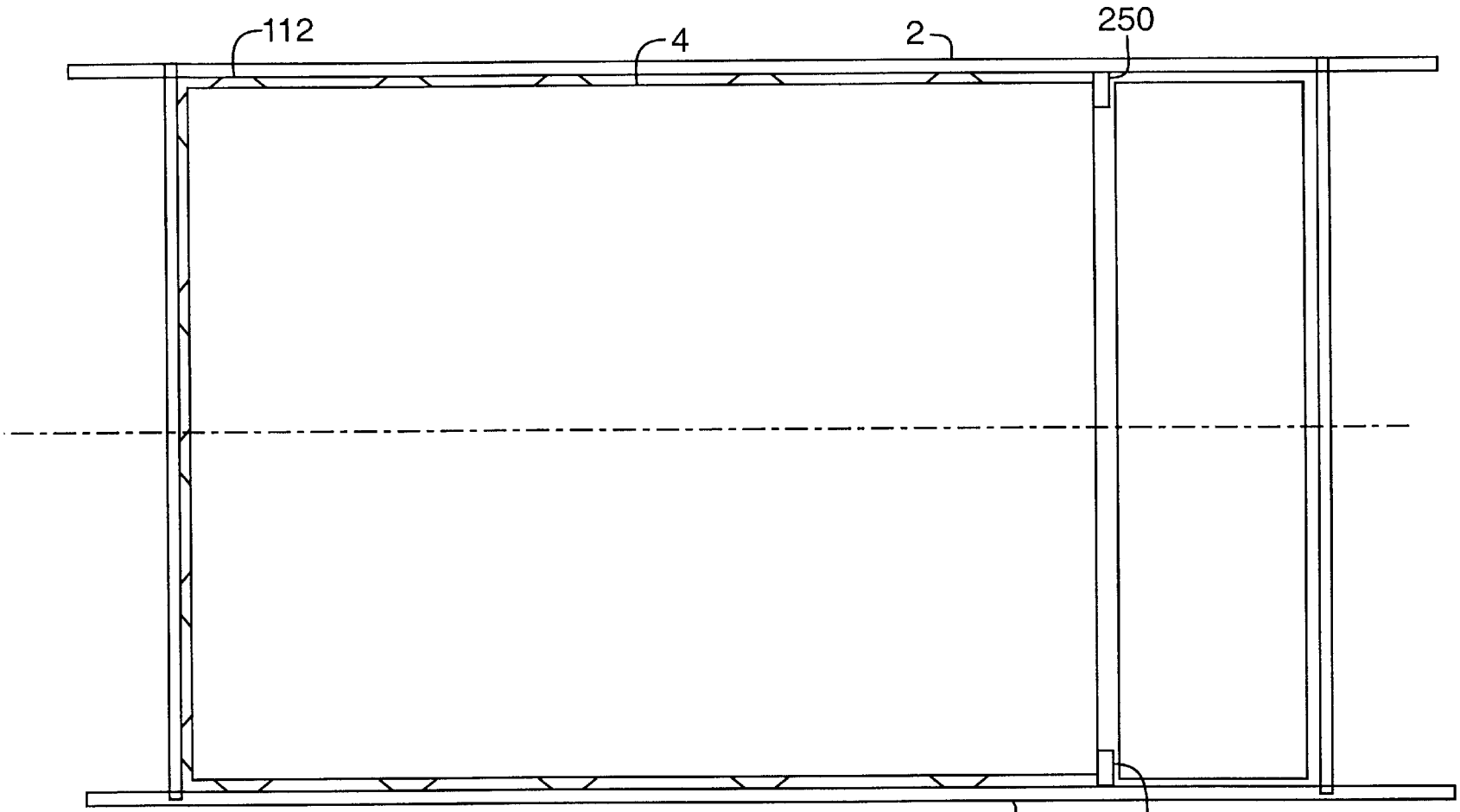
FIG. 40 is a top view of a space grillage between side bulkheads.

Whichever flexible connecting structure is used, preferably stoppers 250 are mounted to the side bulkheads 2 to prevent the grillage 4 from longitudinal movement, as shown schematically in FIG. 40. The illustrated stoppers 250 are rectangular in cross-section, although other shapes could be used, and preferably extend the full height of the grillage.

The plane grillage 39, 39A must withstand a certain amount of longitudinal and transverse force. The main grillage plane 39 is also an important assembly jig at the erection stage of the main module. An equivalent procedure is used on the floor level of the assembly hall. This is one of the means to achieve a good dimensional precision for the main modules.

Since some essential features of the present invention are concentrated to the environment of one cargo space, this kind of overall solution is also applicable in other ship types, as a partial solution or as an overall solution. The cargo transport flexibility in certain old ship types may also be increased, by raising the level of cargo handling technology, and therethrough, even the payload capacity can be increased, within the limits of the same dead weight. The number of cargo cells in new products may also vary. Using cargo cells as a partial solution in transporting vehicle and general cargo is possibly highly justified economically in some other ship types.

Planar profile elements 39A,39B,39C, etc. are sub-assembly units. Accordingly, the roof grillage module 39 consists of the parts of the profile 43, and the grillage structures therebetween have been preassembled into an entity before being mounted on the profile 43.

Figure 9:
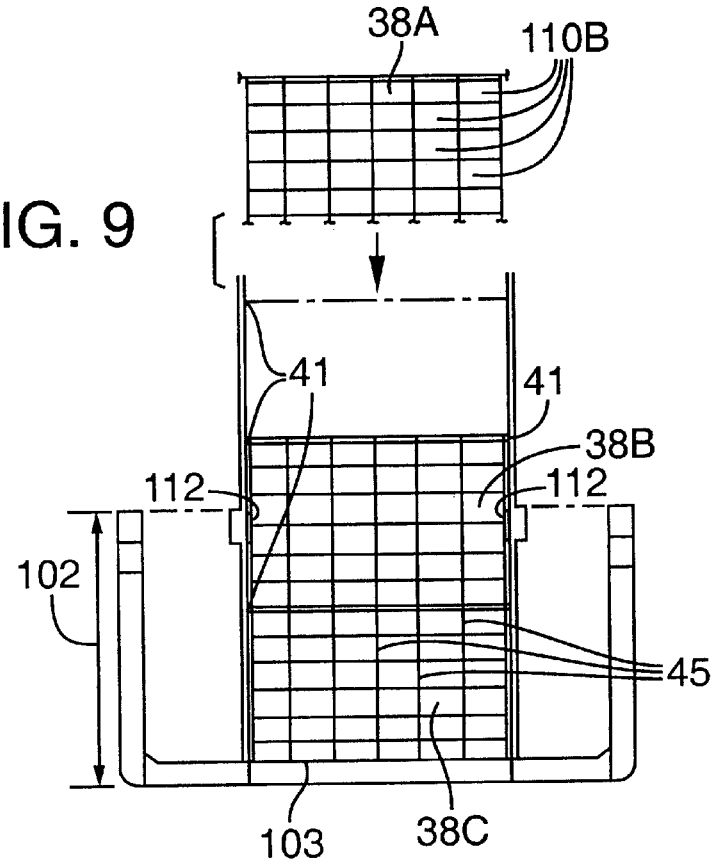
FIG. 9 presents schematically in cross-section the method of the invention for erecting a cargo space with space grillage structure within ship hull.
Figure 10:
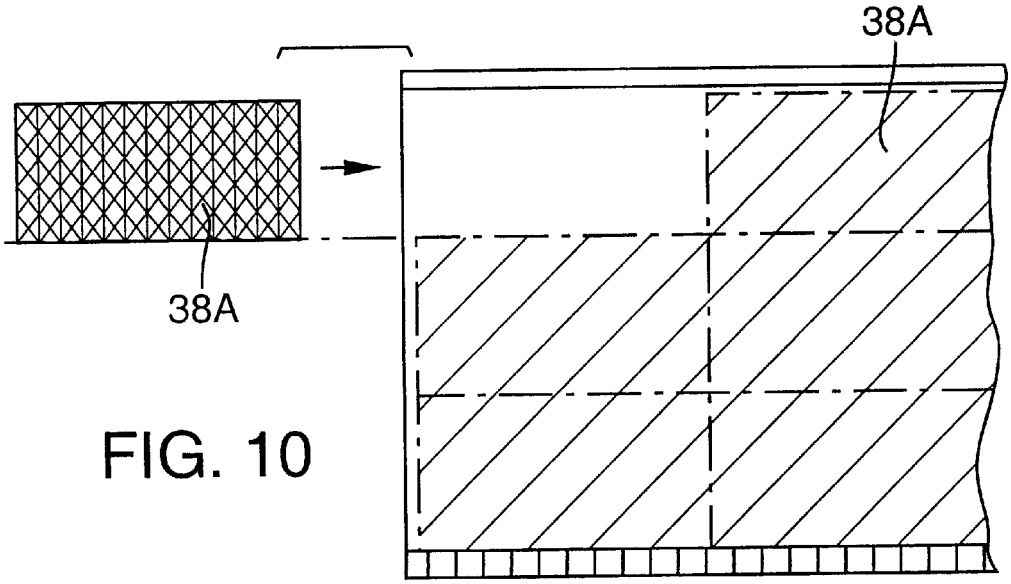
FIG. 10 presents a method for erecting and assembling a space grillage structure composed of modules according to the invention.

FIG. 9 shows an application of assembling a main module 38A in a ship, i.e. conveying it from above in place. Respectively, FIG. 10 shows how the main module 38A is pushed into a cargo space through an open end. The choice depends greatly on how the ship as a whole is erected and assembled. The number of main modules in the vertical and horizontal direction is dependent e.g. on the main dimensions of the ship, the facilities in the building shipyard, and certain aspects related to ship design.

In striving for short delivery times in shipbuilding, an essential way is to shorten the main erection phase. On one hand, said phase is required to consist of end products which are large enough, and the entire assembly chain up to the sub-assembly units and basic components has to be very hierarchical. The main modules 38 composed of space grillage structures with factory-made outfits enable a near complete outfitting of the main modules before being transferred into a ship. Thereby, conditions are created for transferring work away from the ship to shipyard product shops and equipment suppliers. This kind of space grillage structure includes quite a lot of light equipment, but also control automation and other devices. A crucial group of outfits consists of the group of cables, small pipes and potential ducts and channels. In the main module phase at the latest, the cables have to be drawn and the power units in the main modules must be connected, etc. Respectively, provisions are made in systems crossing over the module limits in the sense that e.g. the precut cables have been positioned within a preceding main module for further installation. In some cases extensions or the like will suffice. By operations such as those described above tests can be carried out on certain power means of a main module 38 prior to transfer into the ship, thereby shortening the trial-run period remarkably.

Figure 23:
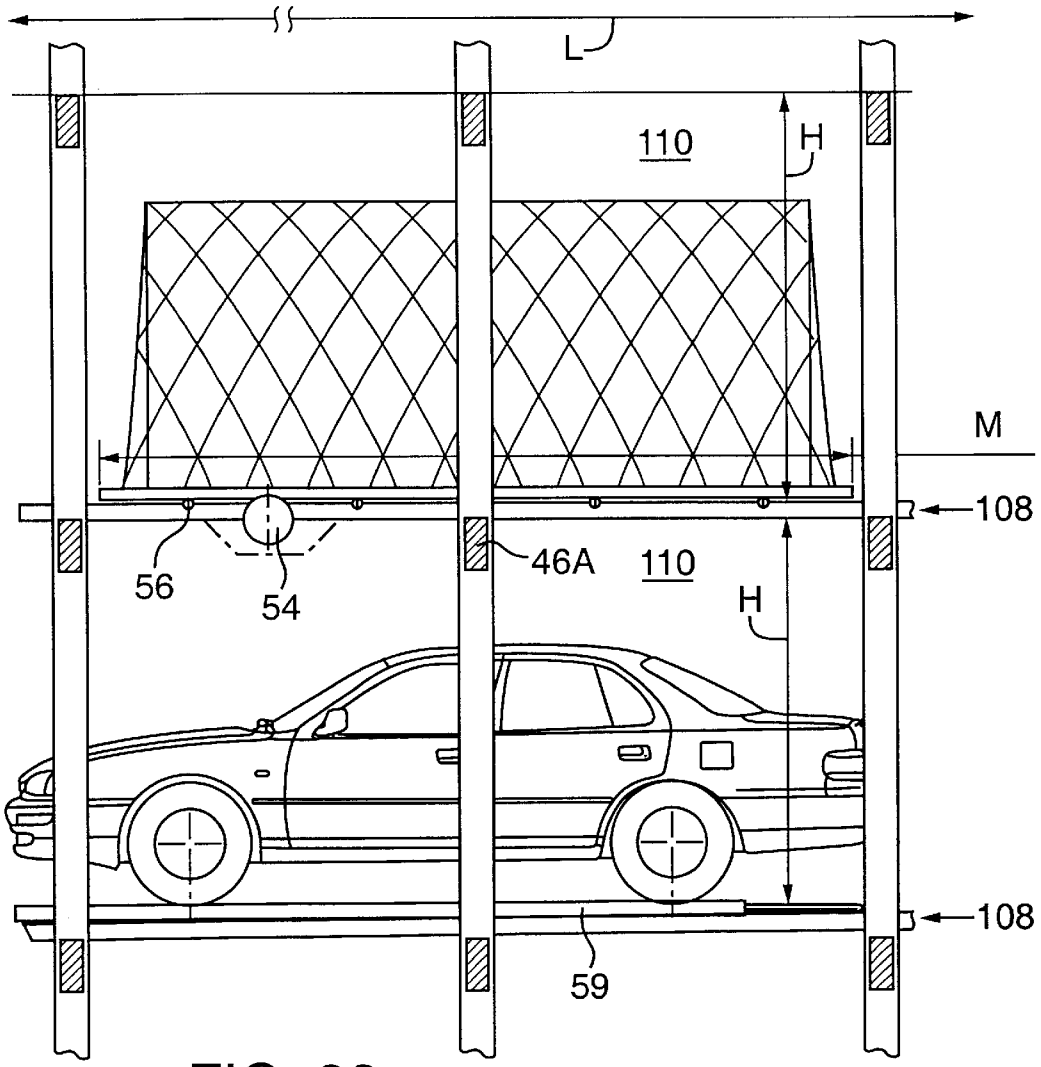
FIG. 23 shows the cargo cell of FIG. 22 as a side section.

So-called service platforms 35 (FIG. 17) in the adjacency of a cargo well are operationally important. If vehicles are driven into the cargo cells by using their own engine power, this application will give more turning room. The first conveyor means of cargo for cargo cells 110 are located on said platforms, remote controlled lock-devices and vertical stair connections may also be concentrated in this area. Manually operated locking means may be also needed. Several prior art technical designs are available for moving cargo pallets and locking them up in place in a cargo cell. One of such techniques is shown in FIG. 23, i.e. small floor roll-elements 56 close to each other and remote controlled power rolls 54 for transferring the cargo. The handrails 35A (FIG. 17) of a service platform have to be remote-controlled, turnable or vertically movable constructions. The lift platform must be provided with a control panel for guiding and controlling the overall situation.

The floors 55 (FIG. 22),107 (FIG. 26) of cargo cells 110 are substantially made of floor elements of light construction, or of sandwich or corrugated core elements 55. In the present instance, transfer roll-elements 54,56 (FIG. 23) are placed at certain intervals in the grooves of the floor panel. Damaged roll-elements can be easily removed and replaced by new ones. The side guides are also compact products and can be easily replaced if needed. Other floor elements used are net plates 56A, as shown in FIG. 22, for ensuring vertical ventilation. The floor structure depends on the power transmission drive units chosen for conveying cargo pallets 57.

Lightweight corrugated core floor elements 60 with good strength characteristics are principally used as floor structures of a cargo cell. Corrugation profiles of this plate are known in the mechanics of materials, a number of strength calculations have been presented on optimal sloping angles and other parameters. As shown in FIG. 27, the loading element in accordance with the present invention is provided with a "lowered" middle part or load surface 115 and higher supporting corrugations 116 on the sides. Various equipment, such as roll-elements, various locking means, etc., needed in transferring the cargo, are meant to be fixed in the groove (that is, the area above load surface 115 and between the corrugations 116) formed by said profile. Said equipment is located in a partly sheltered space, rising above the floor element only as much as is needed. Modulized elements of this kind can be made of thin steel plates, light-alloy plates, such as plates of suitable aluminum-alloys, or other known light, but strong materials. FIG. 26 shows an axonometric drawing of a floor element, with the supporting structure thereinside including four corrugations, though one or more thereof can be provided according to the respective application. The plate is manufactured of three plates 66,67,69 (FIG. 27) pressed into shape, and with variable mutual thicknesses, which is a question of strength-technical optimization and consequently, related to the respective application. Prior art manufacturing designs, such as different welding-technical mounting methods, gluing and riveting or other methods are available for fixing the plates. This kind of element with mounting flanges is easy to attach on the base. A filling box profile 65 between two parallel elements serves as floor filling and in addition, serves essentially as a casing for cable tubing and other small tubing. The cables can be taken out right at an actuator through openings on the upper or lower surface of the profile and connected to the actuator in question. It also suits well as a casing for hydraulic and pneumatic tubing. A number of actuators need these energy sources. The corrugated core elements can be easily modulized in breadth in order to rationalize the industrial manufacturing process.

The material handling chain of palletized car cargo and general cargo forms an integrated complex. The transferring of palletized cargo can be accomplished by means of several prior art techniques. The specification of the present patent application describes one handling method. Loading effectiveness requires that work phases in the ship be reduced and the cargo be handled in larger units.

When the transfer and fastening of cars onto cargo pallets takes place in harbour terminals, less fastening phases are needed onboard. The present invention presents an adjustable car transport pallet 59 in FIG. 24. Said transport pallet 59 has by adopting the use of light-structure—technical design been made light in weight. Its use, however, requires continuous "from roll to roll" transfer or the like. Nevertheless, the pallet is more rigid than those used in air-freight. As taught by the invention, the pallet is provided with an adjustable rear part needed when all passenger cars or equivalent are to be accommodated in their overall length within the dimensions M of the cargo pallet. In the cargo cells 10, the cargo pallets 59 are positioned close to one another. The respective length dimensions of passenger cars and vans vary within the range of slightly over one meter, i.e. from 1.0 to 1.5 m. The length flexibility provided by the pallets is a crucial, if not essential factor in effective loading of a ship. Various optimal lengths can easily be determined for the cargo cells, to enable appropriate loading of products of varying lengths in one cargo cell.

The cargo is lashed in a harbour terminal or by a customer onto a pallet 59 with a cargo net or cargo lines e.g. by means of the present-day, widely used technique. In the harbour terminal the loaded pallets are fed onto a sorting table 20 alongside the ship in the order of loading. Pallets with rolls are needed for the transfer. Ports of discharge, customer groups and product groups can well be taken into consideration in this phase. Respectively, general cargo 57 can also be placed on cargo pallets meant for cars, said pallet being provided only with the trough part, easily accommodating standard transport bases. Other general cargo 57 may also be placed on length-adjustable pallets, utilizing their whole length.

The palletized cargo is transferred with transport platforms, the bottom thereof being equipped with actuators appropriate for transferring pallets. From these the cargo is transferred onto a sorting table 20. The sorting table is a buffert place and also of the same breadth as the new cargo spaces of the largest ships. This arrangement enables the cargo cells to be loaded on the same level "in one loading." As many cargo pallets as there are cargo cell lines in one plane are transferred side by side onto a combined lift/transfer platform.

The lift platform is filled with cargo pallets. As the pallets are of standard breadth, they stand fairly exactly in the line of the openings of the cargo cells. At this stage the transverse conveyor units 49 (FIG. 16) on the lift platform are in operation, i.e. the transfer of the cargo along the longitudinal axis of the ship may start. It is essential for loading effectiveness that the pallet rows of each stock are handled in one operation. The use of a two- or multi-stock lift platform as presented here increases loading effectiveness because the time-consuming transfer from a lift platform or from the cargo cells onto a lift platform can be carried out simultaneously on several levels. In a wide well the floor levels of every second cargo cell can be adjusted to be at the level of those of lift platforms, in the vertical direction the successive stocks/cargo platforms 108 can already be leveled in the narrow wells. One-stock lift platforms 11 (FIG. 1) may also be used in cargo wells.

As shown in FIG. 6, the power units 34,36 of the bowpart lift platform 12 are placed on the uppermost deck in the proximity of the cargo well. Said power units have to be synchronized to act together, which can be successfully done with modern control techniques.

The power units can also be positioned on the bottom level of a cargo well of the ship. The same power-unit technology as in the bowpart cargo well can also be used for the lift platform in the lower afterbody cargo well, although any other basic technique for creating movement known in the art may also serve the same purpose.

A ship of this kind trims and heels in the loading phase, the movements caused whereby are compensated e.g. by means of heeling tanks. The technical starting point must, however, be that a lift platform is able to operate at certain trim and heeling angles. The guide rails 53 (FIG. 17) and the guide wheels 56D (FIG. 19) resting thereon play a significant role in such situations. The guiding effect of the guide wheels is better with lift platforms of two or more stocks. The lift platform has to be supported in both longitudinal and transverse directions. The actuators of a lift platform can be equipped with speed and load control automation according to present day technology. Lower speeds have to be used for heavy pallet loads and higher lifting speeds for light car loads. On the surface of a lift platform, the transverse cargo conveyor means are known in the art. While the cargo pallets are on lift platforms, cargo transfer means paralleling the longitudinal axis of the ship are employed wherewith the cargo is transferred to be within the reach of the actuating means of the cargo cell.

On the floor level of a cargo cell, actuating means known in the present-day techniques are provided, wherewith the cargo pallet is transferred forward. Also guide rolls 50 (FIG. 16) are also provided on the sides of a cargo cell at regular intervals to ensure a free passage for cargo pallets 59. The cargo pallets may be pushed close enough to touch one another. Depending on the general arrangement, separate cargo pallets in the middle can be locked to the base, or a common locking can be carried out, i.e. the last cargo pallet on the lift-platform side is locked to the base. For the sake of safety, a double or triple locking security may be needed on a cargo line. Some can be remote-controlled with automatic locking devices, others manually controlled.

The cargo cell includes a special profile 72 (FIG. 30) to prevent the transport pallet from overturning when the ship heels. Respectively, as the cargo had been fastened to the cargo pallet in the terminal phase, the total fastening time of the cargo with all steps in the ship phase is significantly shorter in the new system since separate fastening is no longer needed in the ship phase. The primary function of the special profile is therefore to limit the vertical movement of a cargo pallet, and eventually, to prevent the pallet from tilting, the secondary function is to act as a side guide for vehicles. When a vehicle is driven within a cargo cell, the function of the side profile is to eliminate all contacts with vertical pillars 45 and other such crashes by guiding, via the wheel sides, the longitudinal steering of the vehicle in unexpected situations. Said profile is equipped with an elastic profile 73 to prevent the paint of the vehicles from being damaged.

The same principle applies to loading both cargo pallets and vehicle pallets on transport means. In practice, the heavier general cargo pallets are loaded first into the lowest cargo cells 110A, and thereafter, the lighter vehicle pallets in the upper cargo cells 110B. This is common on the return cargo voyage. On the arrival voyage the cargo spaces are often filled merely with vehicle pallets.

The loading and unloading of container cargo from the container holds 7 is carried out with container cranes operating with techniques known in the art, said containers being provided with spreader and gripping plates grabbing the top surface of the container 100. In the harbours all over the world a trend is gaining ground in which the harbours are required to master, in addition to their field of specialization, also other forms of material-handling. Hence, particularly the harbours specializing in mass handling of containers are nowadays also trying to attract other kinds of cargo ships to arrive in their ranges.

Figure 1:
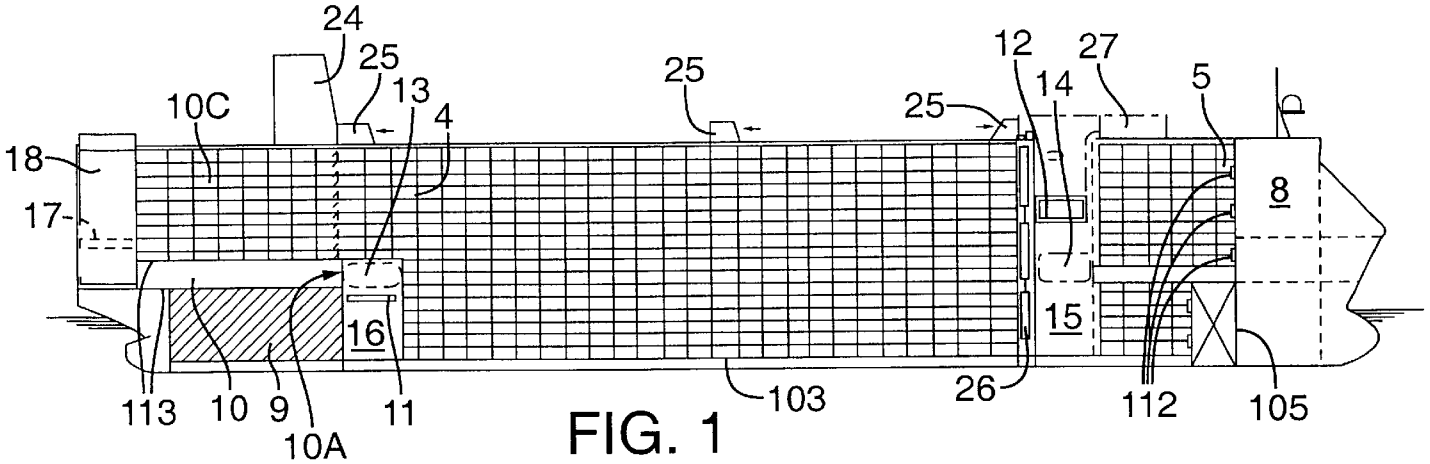
FIG. 1 presents in general image a longitudinal section of an embodiment of a ship based on the invention.
Figure 2:
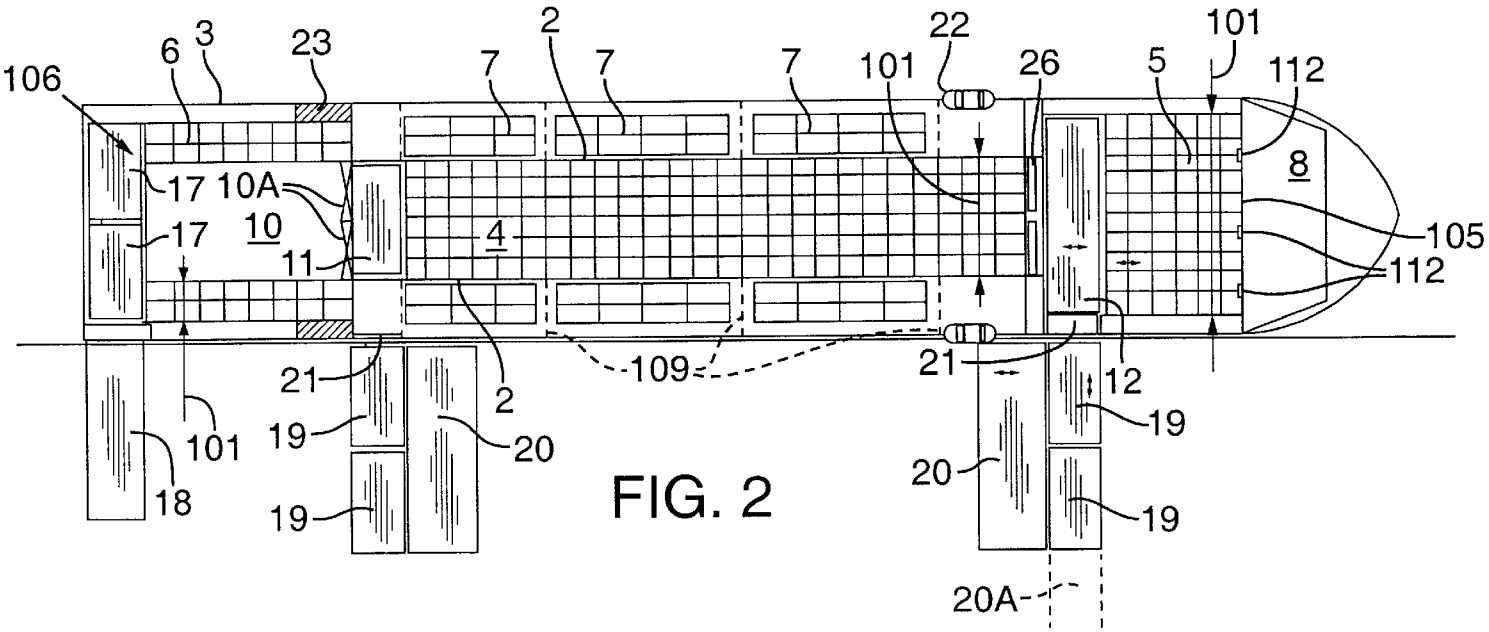
FIG. 2 shows a horizontal section of a ship of FIG. 1 seen from the upper deck level.

FIG. 1 is a longitudinal section of a cargo space 4 in the middle part and of a cargo space in the bow part, and of cargo spaces 6 in side parts of the stern space. The ship is provided with a hull 1, the accommodation spaces 8 thereof being located in the bow, machinery spaces 9 in the stern, a conventional deck arrangement 10 for heavy wheeled cargo above the machinery spaces. There are two funnels 24 located on the edge of the side shells. Machinery casings 23, as shown in FIG. 2, are located above the main deck in spaces of the breadth of the double skin of the shell. Said casings house exhaust pipes, silencers, service platforms and other equipment. The ship is equipped with a stern ramp 18 opening onto one side. Reference numeral 13 refers to a side port of the afterbody cargo well 16 and reference numeral 14 to a side port of the forebody cargo well. Intakes of ventilation air are positioned in three locations 25. Next to the middle cargo space towards bow is provided a so-called transverse cofferdam 26 where equipment and nozzle openings required in ventilation and air-conditioning of the middle spaces are placed. Reference numeral 11 refers to an afterbody well lift platform, and reference numeral 12 to the lift platform 12 of the bow part well 15.

FIG. 2 shows a layout of the main deck level seen from above. Reference numeral 17 refers to the sternmost lift platforms wherefrom the open ends of the cargo spaces are directly accessible. In front of the machinery spaces is located the afterbody lift platform 11, whereto the cargo is transferred through the side port 13 or, alternatively, through an opening 10A in the heavy cargo deck 113 and the lift platform of the bowpart cargo space extending over the entire breadth 104 of the ship indicated by reference numeral 12. Space reservation for the machinery casings is indicated by reference numeral 23. The container holds 7 are located on the sides of the ship, and in front of them the lifeboat stations 22. The container holds are divided transversely with fixed or partly adjustable vertical support bulkheads 109 known in the art, on which part of the guide rails of the containers 100 are mounted. The stern ramp in lowered position is indicated by reference numeral 18. Depending on the requirements, the forebody port 14 (FIG. 1) is provided with a port structure with standard actuators or with a view of alternative use, with a side port. The hinge part of the prior art side port can be slid upwards by one to two conventional deck heights. Said procedure enables technically the use of the quay facilities mentioned in the specification part of the present patent application or separate use of the side port. The cargo transfer and quay facilities for the middlemost cargo space and the stern well are as follows: a sorting table 20 provided with rollers or other known cargo transferring actuating means, a combined lift/transfer platform 19, an intermediate platform 21 provided with conveyor actuating means located upon the lower edge of the side opening of the ship, wherefrom the cargo is transferred to the lift platform. The same equipment is provided at the bowpart opening, and in addition, an alternative solution for the location 20A of the sorting table, whereby a more straightforward passage is provided for the pallets, though respectively, more space is needed in this direction. A cofferdam for ventilation and air-conditioning modules is shown in top view at 26.

As a summary of FIGS. 1 and 2, one may see that primarily the vehicle and general goods cargo spaces of the ship are arranged to be located in the middle part of the hull, in a high tower-like cargo space 4, this being a self-supporting space grillage in structure and so dimensioned that it is not actually intended for participating in bearing the total strength of the ship, and in the longitudinal tubular cargo cells 110 positioned thereinside the cars and palletized general goods are accommodated using the power means of their own, the actuating means of the cargo cell or external actuating means, or muscular force. On both sides of the vehicle cargo space, prior art container holds 7 are provided, open in the upper parts, though distinctly lower, into which the containers 100 are hoisted or lifted from above, the upper surface of said spaces being defined by the upper deck 28 or the side height 102, and frequently at the same time, by the strength deck. Instead of the cargo space being divided into a number of parts 10C, 6, 5, 4 as has been described, the car cargo space may extend from the stern 106 to the bowpart peak bulkhead 105 as an integral part. The cargo spaces are smaller in breadth 101 than the breadth 104 of the ship, or they may be widened, extending over the entire breadth 104 of the ship in alternative situations, e.g. in the stern or bow areas, thus binding the narrow cargo space in the midship. The cargo space sections 4, 5, 6, 10C of space grillage structure in general extend from the double bottom 103 of the ship to the roof of the cargo space, but they may also extend only part of the height available, starting from the bearing intermediate bottom 113, such as the cargo space section of the stern part (see FIG. 3). The separating transverse bulkheads 105, 109 stretch, in some cases, in vertical direction only up to a part of the side height 102, while the upper part of the space is open in longitudinal direction, whereby a lift platform, or even cargo, can be transferred from one cargo section to another. Instead of container holds, or in addition thereto, a ship according to the present invention may also be provided with a tank-like hold or holds for bulk goods, preferably positioned in a similar fashion as the container holds, i.e. in the lower parts of the ship, that is, on top of the double bottom 103 or equivalent bearing deck 113.

Figure 3:
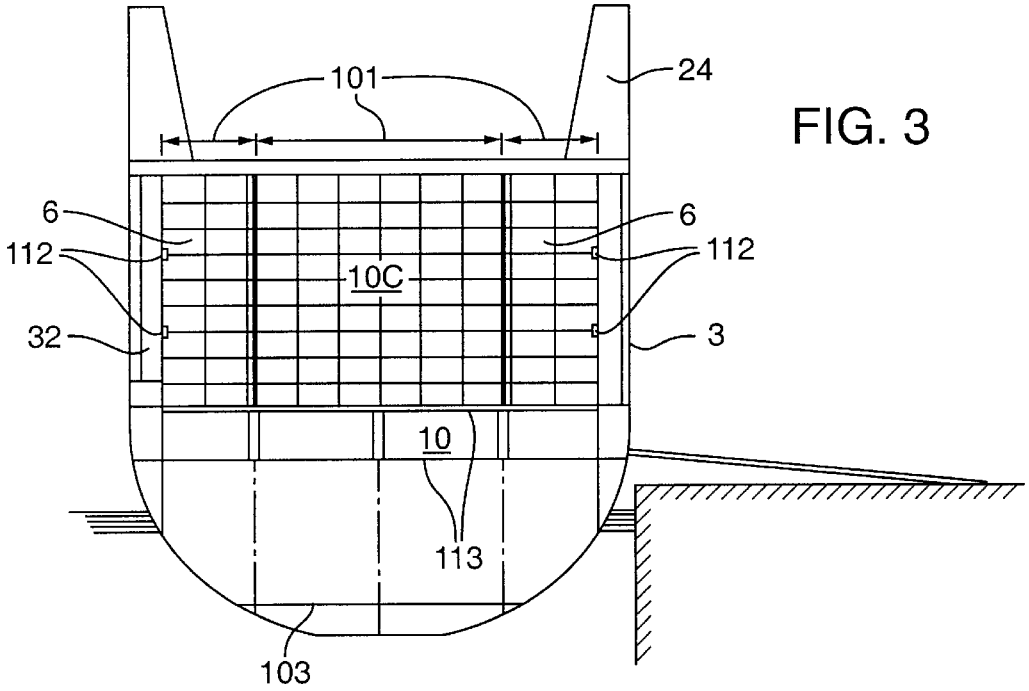
FIG. 3 shows a cross-section of the ship of FIG. 1, stern part.
Figure 4:
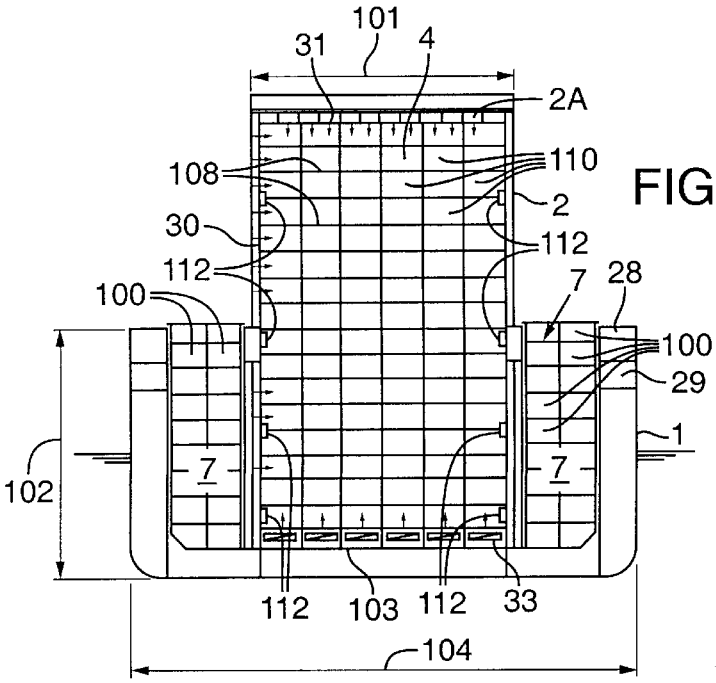
FIG. 4 shows a cross-section of the ship of FIG. 1, midship.

In FIG. 3 a cross-section of the stern part of a ship is shown. The middlemost cargo space 10C extends up to the stern 106, and on both sides thereof are provided side cargo spaces 6 outfitted with the same technique. The ventilation and air-conditioning modules of said space are located in the side spaces 32, the spaces in the fore parts of the side section are reserved for the machinery casings 23. The present alternative shows the heavy cargo deck 113 on which the heaviest and highest vehicles or general cargo units may be positioned. Chartering vehicles drive along a side ramp onto the deck. The sternpart of the lift platforms 17 forms a closed bulkhead construction, as indicated in FIG. 2.

FIG. 4 shows cross-section of the centrepart of a ship at the container holds. The ship includes a double skin provided with a double bottom 103, and at the upper part of said double skin being provided a very strong torsion-resisting boxgirder structure 28. In the present instance, said structure defines the bearing side height 102. Therebelow can be seen another boxgirder 29, forming an internal service corridor. Containers 100 are loaded, by means of known modern technique, into holds without hatch covers. The lengths of the container holds 7 have to be dimensioned on the basis of the 20' and 40' basic containers, but also the 45', 48', 49' containers, at least some of them have to be accommodated therein. In the container holds, transverse support bulkheads 109, fixed and or partly adjustable, have been positioned between the containers, being of prior art technique and provided in part with guiding rails thereon for containers 100. Normally, containers may be loaded also above the main deck 28, i.e. as deck cargo. Said quantities depend on the amount, location and stowage factor of the rest of the cargo. FIGS. 1 to 4 present also a space grillage structure 4, with cargo cells 110 therein, as well as the flexible connecting elements 112 connecting the space grillage to the ship hull 1. The flexible connection to the bearing ship hull 1 is necessary so that the deformations of the ship hull, caused e.g. by rough seas, would not in some parts be transmitted more than in some parts to the cargo spaces 4, 5, 6, 10C of the space grillage structure. The figures show also cargo space breadth alternatives of space grillage structure compared to the breadth of the hull 1, as well as typical heights of said cargo space, in general preferably exceeding the bearing side height 102.

The so called "cross-ventilation" principle of the cargo space is seen clearly from the drawing: (1) a homogeneous roof construction 2A makes good hull channels 31 possible, on the lower surfaces of which nozzles can be easily installed at regular intervals; (2) in the example of the figure, the longitudinal bulkhead 2 supporting the middle space 4 has been positioned externally to said space, part of said bulkhead consisting of box girders 30 which may also be employed as ventilation ducts, and reserving locations for nozzles on the sides; (3) cargo cell-specific ventilation duct lines 33 with nozzles on the bottom, below the space grillage.

FIG. 5 shows the positioning of lifeboats 22 down on the so-called strength deck.

FIG. 6 shows a cross-section of the widemost bowpart cargo space. A multi-stock lift platform 12 with power units 34, 36, shown in the figure, is located on the uppermost deck.

It is technically possible for the power units to be positioned also in the lower part of the well. A combined cargo lift-transfer means module 19, 20, 21, with a cargo pallet for loading, is shown on the quay. Initially, the pallet was placed on the sorting table 20. The middle platform included in the ship is shown at point 21 in the figure. Also the vertical pillars 45 of space grillage structure are shown schematically in the figure, as well as the cargo cells 110 and the cargo platforms 108 thereof on top of the double bottom 103.

FIG. 7A is a more detailed presentation of the double roof construction 2A of the high cargo space. The roof construction comprises channels formed by longitudinal steel elements reinforced by transverse girders 75 at certain intervals. At the transverse girders there is a connection to the hull channel 30 provided by the vertical girder of the high cargo space. Air flow is arranged through openings 74.

FIG. 7B shows an alternative application, a double-roof construction 2B, with the most of the channels in transverse direction and with only one central channel 77 in the middle for air distribution. At the hull channels 30 also the transverse channels are reinforced 80, elsewhere of a lighter construction 81. On both sides of the hull channel 77 there are openings 78 connecting the transverse channels, part of which being connected to the cargo space by means of air nozzles 76.

FIG. 7C shows another alternative application, a double-roof construction 2C with two separate longitudinal central channels 79 in the middle. Thus the air space of the ship can be divided into two parts. The channels 31 of the cell structure in the roof part of space grillage structure, the cell-resembling vertical hull channels 30 composed of the side girders of the cargo space, and the channel lines 33 installed in the bottom of the cargo space enable effective vertical and horizontal cross-ventilation by regulating the direction of the flow of the exhaust and intake blow channels and the volumetric flows. In addition, at least part of said cargo spaces can be provided with air-conditioning system, in addition to ventilation, that is, with heating of the air to be blown in, and or drying, and or wetting.

Figure 8:
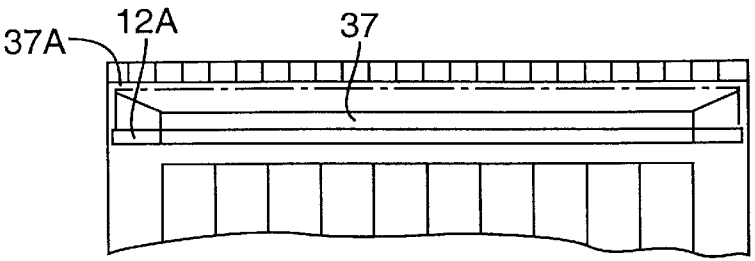
FIG. 8 presents a lift platform arrangement in a ship according to the invention.

FIG. 8 shows an application where the top part of the cargo spaces is open at the ends.

The power units of the lift platforms are mounted on a bridge-beam construction 37 equipped with wheels 37A, and the lift platform 12A has been hung thereon. This arrangement enables one lift platform to be used in more than one cargo wells.

FIG. 9 shows an application, where a main module 38A of a cargo space of space grillage structure is lifted into the centremost well from above. Similarly, it is shown how the cargo space grillage is divided in three parts vertically, the main modules 38A,38B,38C. The number of modules depends, inter alia, on the dimensions of the space, and is from one upwards. The flexible connecting elements at the side structures can be seen at points 112.

Such flexible connections are needed at least with the hull 1 of the ship so that the deformations of the ship hull are not, at least not fully, transferred to the grillage. The grillage is not expected to bear more loads than those directed to itself by the action of the load, and partly of the deceleration forces. Since the question in any case is of some kind of support, part of the effect of the deceleration forces is transferred via the supporting points to the hull, but the support should be such that no inverse transfer of deformation would take place.

FIG. 10 shows a further alternative application in which a main module 38A is pushed in through the open end of the main casing.

Figure 11:
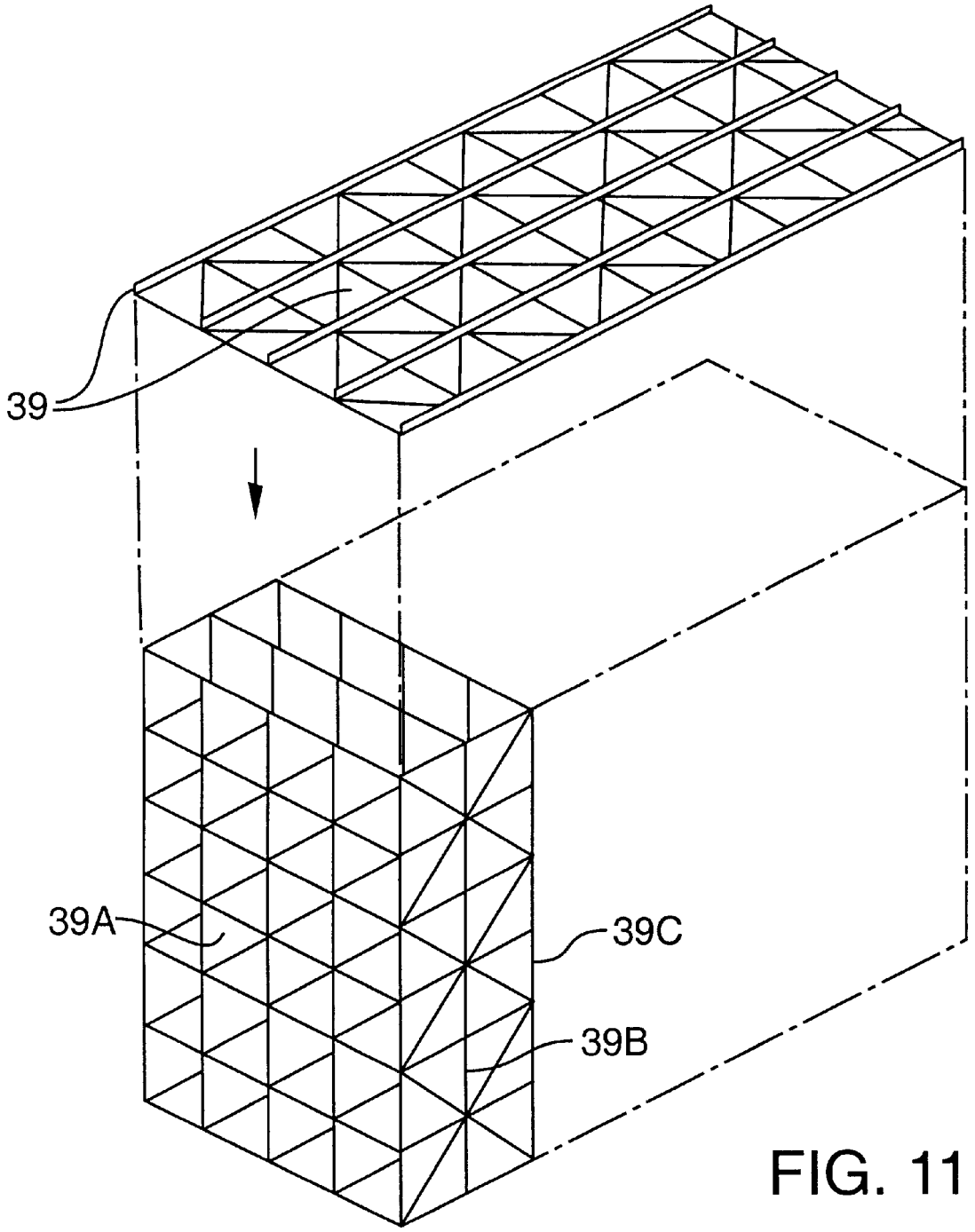
FIG. 11 shows a main module of the space grillage and the roof grillage structure related thereto in axonometric image.

In FIG. 11 is seen an axonometric drawing of the main module in one of the assembly phases. A roof grillage module 39 strengthening and binding the constructions, and including the profiles 43 (which serve as guide rails) of the flexible connecting elements 112, "is lowered" into place only after all transverse pillar elements 39A, 39B, 39C, etc. have been aligned. The vertical pillars 45 (FIGS. 13 and 15) of said plane elements are lowered into the sleeves 43B of the flexible connecting elements that act as mounting jigs on the floor level.

FIG. 12 shows part of the side view of the space grillage 4,5,6 or 10C. The distance between the vertical pillars 45 in longitudinal and width directions is indicated by references 111L, 111B (FIG. 13), respectively. In this phase diagonal struts 46B have already been installed, and the roof grillage 39 is ready to be lowered in place. The outfitted floor elements 55,56A or 107 of a cargo cell 110 are pushed in at the end of the modules, whereby the length of the cargo cell will be the desired length which is equal to the length of a number of cargo units 57,58.

FIG. 13 shows the same situation in front view. The side flexible connecting elements of the roof grillage 39 are located at 112. The vertical pillars 45 have been mounted on assembly jigs, respectively, on the bearing deck 103,113 of the ship, one part whereof being formed by a roof-grillage guide-profile model.

Figure 14:
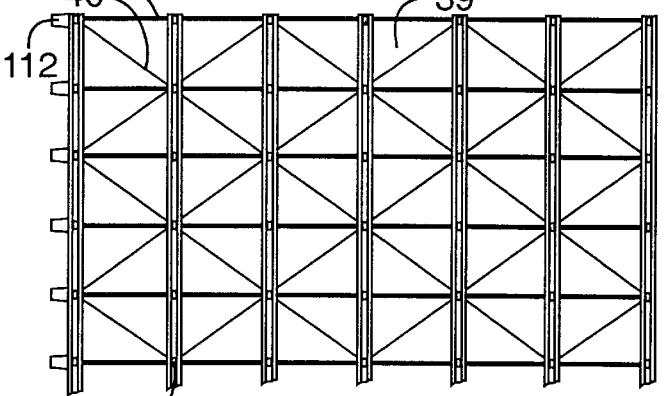
FIG. 14 shows in top view the roof grillage structure of the main module of FIG. 12.

FIG. 14 shows the roof-grillage element 39 from above. The grillage structures binding the guide profiles, composed e.g. of parts 40,42 (FIG. 13), serve for their part as subelements 39A. In this manner a module 38, corresponding in general to parallello piped, can be stiffened preferably by means of a planar stiffening element at least on two sides thereof, or composed of two sides rectangular to one another, such as grillage or plate structure or equivalent. The module may also be stiffened using other means, such as various diagonally positioned beams, rods, grillages or plate structures.

FIG. 15 shows a detail of an important guide profile 43 and constructions related thereto. The guide profile, being of heavier construction, binds a large number of constructions, and therethrough longitudinal and transverse forces being transmitted. As discussed previously, the sleeves 43B of the vertical pillars are placed inside specially shaped profiles 44. This way of mounting a sleeve makes it possible to place it exactly in the right place. The profile 44 surrounding the sleeve binds in turn the leg parts of vertical pillars 45 and the upper parts in line. The sleeves 43A for the upper ends of pillars have been mounted directly on the lower surface of the guide profile. The grillage structure binding horizontally the guide profiles to each other becomes obvious in FIG. 14. It can be seen in the figures that the aim is to manufacture all components industrially using a hierarchical modular structure. This requires excellent control of the manufacturing accuracy, starting from the accuracy in the ship hull and extending to the smallest outfitting modules and components. However, when detachable joints are used in a structure, particularly the locations of the horizontal beams 46, 46A are changeable, particularly in height direction, whereby also the locations of the cargo platforms 108 in vertical direction, i.e. the distances H of the cargo platforms, can be adjusted as need be. Such loose or flexible positioning of the vertical pillars 45 in bodies 43A, 43B enables as desired flexible or yielding support 112 to the hull 1 or to another main module.

FIG. 16 shows a helicopter view of the passage of a cargo pallet from a sorting table on the quay into a cargo tube. The sorting table 20, the lift platform 19, the middle platform 21 and the bowpart lift platform 12 of the ship are equipped with conventional power units actuating cargo transfer. The lift platform aboard the ship is furthermore provided with power units 49 enabling a cargo pallet to be transferred transversely to be within the range of the power units of a cargo cell.

FIG. 17 shows the bowpart cargo well, the bow of the ship being on the left. The cargo cells, cargo platforms, and diagonal struts have been omitted for the sake of clarity. The service platforms 35 and the rail elements 35A with actuators are shown at the ends of the cargo cells. On the bottom of the cargo cells there are ventilation ducts 33. A two-stock lift platform 12, guide rails 53 for guiding the lift platform, being supporting wires 53A in this case, power units 34,36 on the uppermost deck, and a movable shelter roof 27 of the lift platform are shown.

Figure 18:
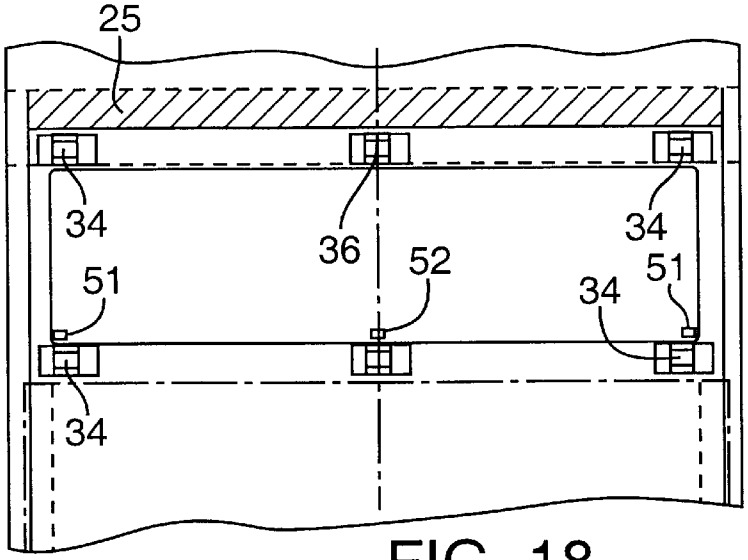
FIG. 18 shows in top view a cargo well opening.

FIG. 18 shows a view of the cargo-well area on the uppermost deck. Six power units 34,36 are shown. Guide profiles 51,52 are seen at the corners and in the middle of the stern part. Also shown is a movable shelter roof 27 with its rails in the deck and air intake chambers 25 of the ventilation means in the cofferdam.

Figure 19:
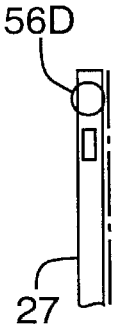
FIG. 19 shows a detail of how the lift-platform guide rolls function.

FIG. 19 shows a principle image of guide rolls 56D. The guide rolls control both longitudinal and transverse movements.

FIG. 20 shows a transverse view of a lift platform construction 54 seen from the stern bulkhead of the well. In a broad well the strength-mechanical advantages gained by grillage structures for lightening the construction and keeping bends under control should be made use of.

FIG. 21 shows a side view of the above construction. The guide rolls 56D are also seen in the figure.

FIG. 22 shows a front view of a detail from within the cargo cell 110. In the topmost cell, general cargo 57 on a pallet and on cargo pallet 108 lashed with a cargo net 57. In a lower cell there is a passenger car 58 placed on a length-adjustable car pallet 59. The figure shows the power unit, e.g. a power roll 54, which is an alternative technical means for transferring cargo in a cargo cell, standard roll elements 56, a corrugated core floor element 60, a conventional steel-net floor element 56A. The side guide rolls 50 for pallets have been placed on a longitudinal girder binding the vertical pillars. A special profile 46D restricts heeling, at the same time acting as a side guide for car wheels. All pallets are pushed into a long cargo cell in the longitudinal direction L thereof. The height H of the cargo cells can be adjustable, e.g. by changing the distance of the cargo platforms shown in FIGS. 12 to 15.

FIG. 23 shows a side view or the above case. At least the cars have been placed on a length-adjustable cargo pallet 59 so that the cars or the rest of the cargo can be packed closely one after the other in a cargo cell, in other words, it is the length of a cargo unit, not e.g. the fixed length of a pallet, which determines the compactness of packaging. The space grillage producing this cargo space consists of cargo platforms 108 adjustable in height and breadth directions, by replacing or adjusting the bearing parts 45, 46, 46A, 46B whereof, at least the width 110B of the cargo cells 110 and possibly the height H of the cargo cells can be changed flexibly using constructions and methods known in the art.

Figure 24:
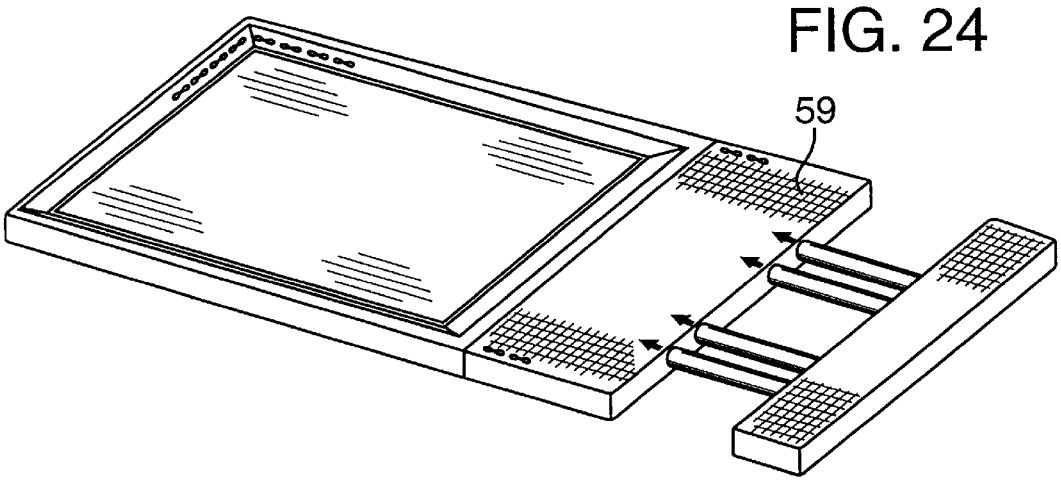
FIG. 24 presents a length-adjustable cargo pallet for vehicle transport according to the invention, axonometric view.

FIG. 24 shows an axonometric drawing of an adjustable cargo pallet 59.

Figure 25:
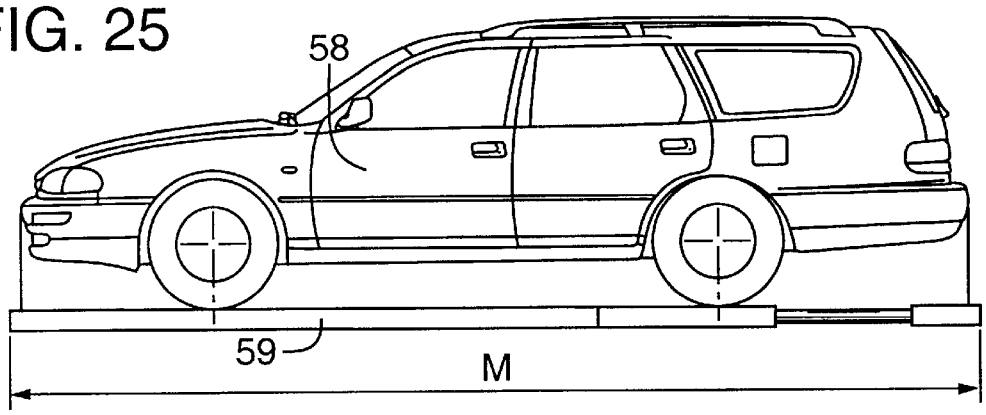
FIG. 25 shows a passenger car on the cargo pallet of FIG. 24, side view.

FIG. 25 shows the location of a car on a cargo pallet. The car wheels are located on the fixed section of the pallet. The adjustable stern part extends marginally over the maximum length of the car so that the entire length of the pallet is M.

FIG. 26 shows a corrugated core element intended for loading which can be used for the floor 107 of a cargo platform.

FIG. 27 shows a way of how to place two corrugated core loading elements 107 next to one another. A loading element comprises a lower loading surface 66 in the middle, with a support corrugated plate 67 under the loading surface, here said plate having four corrugations in parallel, and a bottom plate 69, and higher bearing side corrugations 68. A filling box-profile 65 with e.g. cable tubing or other small tubing 70 has been positioned between the loading elements. A power unit 71 installed on the loading surface extends slightly beyond the centrepart of the top surfaces in the side part of the loading floor element.

FIG. 28 shows alternative forms of box-profile 65 inserted therebetween.

Figure 29:
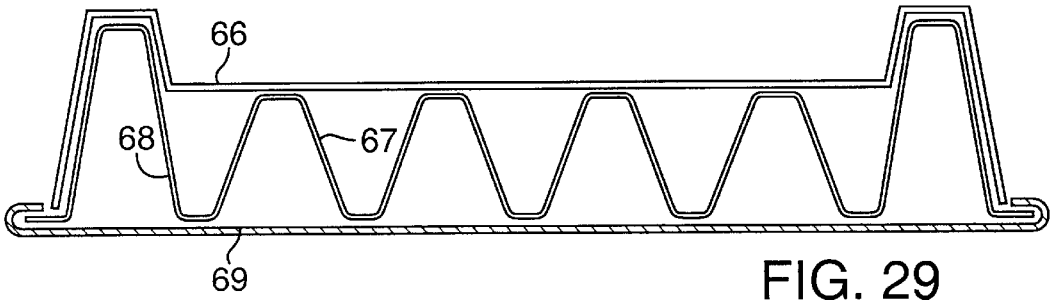
FIG. 29 shows enlarged cross-section of corrugated core floor element.

FIG. 29 shows a cross-section of a corrugated core loading floor element 107, the profile whereof being made of three parts 66/67, 68, and 69.

Figure 30:
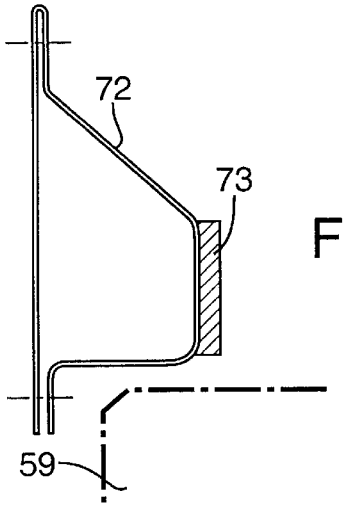
FIG. 30 shows a profile limiting the vertical movement of a pallet entering a cargo cell, cross-section.

FIG. 30 shows a limiting profile 72 for limiting the vertical movements of a pallet in a cargo cell 110, one corner of said cargo pallet 59 remaining thereunder, and an elastic protection belt 73 to protect vehicles.

Figure 31:
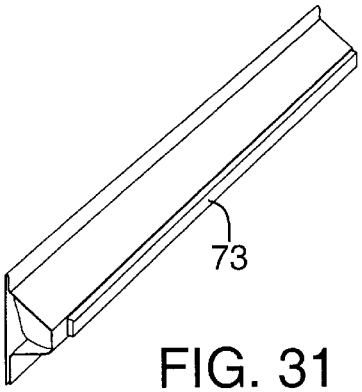
FIG. 31 shows an axonometric view of the profile in FIG. 30.

FIG. 31 shows said profile belt 73 in axonometric view.

It is obvious to a person skilled in the art that various applications of the invention may vary within the scope of the claims presented below, and the invention is not therefore confined to the embodiments and ship types described above.

The invention claimed is:

1. A ship capable of transporting vehicles and other cargo units simultaneously, comprising:

a load-bearing hull having a bottom structure and a side structure;

a cargo space defined within the hull;

a self-bearing cargo space grillage positioned in the cargo space, the cargo space grillage being substantially entirely supported by the hull bottom structure; and flexible mounting means for mounting said space grillage to the hull side structure and hull bottom to permit movement of said grillage relative to said hull side structure and hull bottom structure so as to diminish transmittal of hull side structure and hull bottom structure deflection to the cargo space grillage, the cargo space grillage having an upper channel structure defining ventilating upper channels in the grillage, a vertical channel structure defining ventilating vertical channels in the grillage; and a bottom channel structure defining ventilating lower channels in the grillage;

whereby the upper channels, lower channels, and vertical channels permit effective ventilation of the cargo space grillage.

2. A cargo ship according to claim 1, wherein the cargo space grillage comprises elongate cargo cells provided with loading platforms extending longitudinally of the cells and along which cargo cells units may be positioned closely in succession, and the loading platforms being vertically adjustable for establishing selected cargo cell heights as appropriate for particular cargo units.

3. A cargo ship according to claim 2, wherein actuators are disposed within the cargo cells to position cargo units within the cargo cells.

4. A cargo ship according to claim 1 further including a sleeve mounted to the hull bottom structure and into which fits a portion of the cargo space grillage, the sleeve having an interior surface and being sized to allow clearance between the interior surface and the cargo space grillage.

5. A cargo ship capable of transporting vehicles and other cargo units simultaneously, comprising:

a hull having a bottom structure and opposite side structures that form a load-bearing shell with a side-to-side breadth dimension;

a cargo space defined within the hull;

a cargo handling opening defined in the hull permitting cargo to be moved in and out of the cargo space;

a first cargo section defined within the cargo space, the first cargo section having a cargo space grillage that includes cargo cells, the cargo space grillage being self-supporting and mounted to the hull for movement relative thereto so as to diminish the transmission of hull deformation loads to the cargo space grillage, the first cargo section capable of receiving vehicles; and a second cargo section defined within the cargo space, the second cargo section comprising a cargo hold provided with guides, the second cargo section being located below the first cargo section, the second cargo section being capable of receiving relatively heavy platform-held and container-held cargo in order to provide ballast for the ship.

6. A cargo ship according to claim 5, wherein:

the hull side structures have a selected height and being spaced apart by a selected breadth dimension;

the first cargo section extends upwardly to above the selected height of the side structures, the first cargo section having a first cargo breadth dimension that is substantially less than the side-to-side breadth dimension, the first cargo section being positioned in a center portion of the cargo space spaced apart from the hull side structures; and the second cargo section is positioned adjacent the hull side structures.

7. A cargo ship according to claim 5, wherein:

the hull side structures have a selected height; and the first cargo section extends upwardly to above the selected height of the side structures, the first cargo section having a first cargo breadth dimension that is substantially less than the side-to-side breadth dimension.

8. A cargo ship according to claim 5, wherein:

the second cargo section forms a hold for holding bulk cargo, the hold being located in a bottom portion of the hull on top of the hull bottom structure; and the first cargo section being disposed on top of the second cargo section, and the first cargo section extending along substantially the entire breadth dimension of the hull.

9. A cargo ship according to claim 5, wherein the hull bottom structure has a double-wall structure.

10. A cargo ship according to claim 5, wherein the hull has an aft stern portion and a forward bowpeak bulkhead separated by a selected cargo space length dimension, and the first cargo section extends along substantially the entire cargo space length dimension.

11. A cargo ship according to claim 5, further comprising cargo handling equipment positioned within the hull to move cargo around the cargo space.

12. A cargo ship according to claim 5, wherein the cargo cells of the cargo space grillage comprise elongate tubular cargo cells provided with loading platforms extending longitudinally of the cells and along which cargo units may be positioned closely in succession, and the loading platforms are vertically adjustable for establishing selected cargo cell heights as appropriate for particular cargo units.

13. A cargo ship according to claim 12, wherein the cargo cells are oriented longitudinally of the ship, and the cargo cells each have a length that corresponds to the length of at least two cargo units.

14. A cargo ship according to claim 5, wherein:

the hull side structure has a selected height, and the ship has transverse bulkheads that extend transversely of the ship to divide the cargo space, the transverse bulkheads extending upward to a bulkhead height that is less than the hull side structure height;

an upper part of the hull is devoid of structure to permit cargo transfer; and vertical well spaces are defined within the cargo space, the well spaces being provided with lifting equipment for conveying cargo units vertically within the well spaces.

15. A cargo ship according to claim 5, wherein:

the cargo space grillage has a roof with a double skin structure having internal stiffening girders, whereby the double skin structure and the girders define upper frame channels;

the cargo space grillage has vertical pillars and a bottom part provided with box girders, the box girders forming lower frame channels under and between the vertical pillars, and the vertical pillars forming vertical frame channels; and whereby the upper frame channels, lower frame channels, and vertical frame channels permit effective ventilation of the first cargo section.

16. A cargo ship according to claim 5, wherein the first and second cargo sections are connected by flexible mounting means.

17. A ship capable of transporting vehicles and other cargo units simultaneously, comprising:

a load-bearing hull having a bottom structure;

a cargo space defined within the hull;

at least one cargo handling opening defined in the hull permitting cargo to be moved in and out of the cargo space;

a cargo space grillage positioned in the cargo space, the cargo space grillage being formed of at least one module comprising vertical pillars, longitudinal horizontal beams, transverse horizontal beams, and loading platforms defining cargo cells, the cargo space grillage being stiffened on at least two sides thereof by stiffening elements, and the hull bottom structure supporting substantially the entire weight of the cargo space grillage, and at least one connection member for mounting one of the vertical pillars of the space grillage to the bottom structure of the hull, the connection member defining an interior space into which fits the vertical pillar, the interior space being sized at least slightly larger than the vertical pillar to allow the vertical pillar and thus the space grillage to move relative to the bottom structure.

18. The ship of claim 17, wherein at least some of the vertical pillars of the at least one module are spaced apart.

19. The ship of claim 17, wherein the sides of the at least one module are connected to the hull by flexible connecting elements.

20. The ship of claim 17, wherein at least one module includes an upper module and a lower module, and the upper module and the lower module are connected by lower ends of the vertical pillars of the upper module being mounted to the said longitudinal horizontal beams, and upper ends of the vertical pillars of the lower module being mounted to the said longitudinal horizontal beams.

21. The ship of claim 17, wherein the at least one module is self-supporting, and is capable of being pre-assembled and then being transferred into the cargo space.

22. The ship of claim 17, wherein electrical wiring is installed in the at least one module.

23. The ship of claim 17, wherein the at least one module is removably mounted to the hull within the cargo space to permit selective removal of the at least one module to permit selective configuration of the cargo space.

24. The ship of claim 17, wherein the at least one module comprises:

planar elements including a profile structure, vertical pillars and horizontal supports, with each planar element being connected to other planar elements by diagonal struts, additional horizontal supports, and planar stiffening elements; and a rigid roof element secured to the top of the at least one module.

25. The ship of claim 17, wherein the at least one module comprises loading platforms operably mounted to the vertical pillars, the loading platforms being selectively vertically adjustable to accommodate cargo units of various heights.

26. The ship of claim 25, wherein the loading platforms have upper and lower planar parts that sandwich an internal corrugated structure.

27. The ship of claim 26, wherein the loading platforms each have a central region and longitudinal edges, and the internal corrugated structure has central corrugations of relatively low height in the central region that support the upper planar part to define a cargo support surface, and the internal corrugated structure has edge corrugations of relatively large height along the longitudinal edges that form raised longitudinal edge regions of the loading platforms.

28. The ship of claim 26, wherein projecting profile members are mountable on the vertical pillars alongside the loading platforms to prevent cargo units from overturning and to act as positioning guides.

29. A ship capable of transporting vehicles and other cargo units simultaneously, comprising:

a load-bearing hull having a bottom structure;

a cargo space defined within the hull;

at least one cargo handling opening defined in the hull permitting cargo to be moved in and out of the cargo space;

a cargo space grillage positioned in the cargo space, the cargo space grillage being formed of at least one module comprising vertical pillars, longitudinal horizontal beams, transverse horizontal beams, and loading platforms defining cargo cells, the cargo space grillage being stiffened on at least two sides thereof by stiffening elements, and the hull bottom structure supporting substantially the entire weight of the cargo space grillage, and wherein at least one module includes an upper module and a lower module, and the upper module and the lower module are connected by lower ends of the vertical pillars of the upper module being mounted to the said longitudinal horizontal beams, and upper ends of the vertical pillars of the lower module being mounted to the said longitudinal horizontal beams.

30. A ship capable of transporting vehicles and other cargo units simultaneously, comprising:

a load-bearing hull having a bottom structure and a side structure;

a cargo space defined within the hull;

a self-bearing cargo space grillage positioned in the cargo space, the cargo space grillage being substantially entirely supported by the hull bottom structure; and flexible mounting means for mounting said space grillage to the hull side structure and hull bottom to permit movement of said grillage relative to said hull side structure and hull bottom structure so as to diminish transmittal of hull side structure and hull bottom structure deflection to the cargo space grillage; wherein the space grillage has at least one vertical pillar having a periphery and the flexible mounting means comprises:

a sleeve having an interior surface, the sleeve surrounding the vertical pillar and sized slightly larger the periphery of the vertical pillar so that there is clearance between the interior surface of the sleeve and the periphery of the vertical pillar; and a resilient member positioned in the clearance between the sleeve and the vertical pillar.

31. A ship capable of transporting vehicles and other cargo units simultaneously, comprising:

a load-bearing hull having a bottom structure and a side structure;

a cargo space defined within the hull;

a self-bearing cargo space grillage positioned in the cargo space, the cargo space grillage being substantially entirely supported by the hull bottom structure;

flexible mounting means for mounting said space grillage to the hull side structure and hull bottom to permit movement of said grillage relative to said hull side structure and hull bottom structure so as to diminish transmittal of hull side structure and hull bottom structure deflection to the cargo space grillage;

a roller assembly positioned between the flexible mounting means and the hull side structure; and a rigid pull support mounted to one of the hull side structure and the cargo space grillage, the pull support latching onto the other of the hull side structure and the cargo space grillage to prevent the hull side structure and the cargo space grillage from moving away from each other.

32. A cargo ship according to claim 31, wherein the roller assembly includes a roller holder mounted to the hull side structure, the roller holder holding a cylindrical roller having a vertical axis.

33. A cargo ship according to claim 31, wherein the roller assembly includes a ball bearing roller.

34. A ship capable of transporting vehicles and other cargo units simultaneously, comprising:

a load-bearing hull having a bottom structure and a side structure;

a cargo space defined within the hull;

a self-bearing cargo space grillage positioned in the cargo space, the cargo space grillage being substantially entirely supported by the hull bottom structure; and flexible mounting means for mounting said space grillage to the hull side structure and hull bottom to permit movement of said grillage relative to said hull side structure and hull bottom structure so as to diminish transmittal of hull side structure and hull bottom structure deflection to the cargo space grillage; wherein the cargo space grillage has a forward end and a rearward end, and further comprising at least one stopper located at one of the forward and rearward ends of the grillage.

35. A ship capable of transporting vehicles and other cargo units simultaneously, comprising:

a load-bearing hull having a bottom structure and a side structure;

a cargo space defined within the hull;

a self-bearing cargo space grillage positioned in the cargo space, the cargo space grillage being substantially entirely supported by the hull bottom structure;

flexible mounting means for mounting said space grillage to the hull side structure and hull bottom to permit movement of said grillage relative to said hull side structure and hull bottom structure so as to diminish transmittal of hull side structure and hull bottom structure deflection to the cargo space grillage; and at least one elastic fender positioned between the flexible mounting means and the hull side structure.

36. A cargo ship for transporting light-weight and heavy-weight cargo simultaneously, the ship comprising:

a hull for bearing forces directed at the ship;

a cargo space having two cargo space sections, the first cargo space section having at least one space grillage structure that is self-supporting and flexibly connected to the hull so that the deformations of the hull are not entirely transmitted to the space grillage structure, and the second cargo space section has holds for containing heavy-weight cargo; and wherein the first and second cargo space sections are positioned at least partially adjacent one another for arranging the light-weight cargo to be conveyed up and the heavy-weight cargo into the lower part of the ship to lessen the need for ballast water.

37. A cargo ship according to claim 36 in which the ship hull has a double button, bearing decks, sides having side heights, a breadth between the sides, and middle parts located between the sides, and in which the first cargo space section extends from the double bottom or other bearing deck to a location substantially above the side height of the hull, and wherein the first cargo space section has a smaller breadth than the breadth of the hull, and wherein one of the first and second cargo space sections is positioned in the middle parts of the ship and the other of the first and second cargo space sections is positioned near the sides of the ship.

38. A cargo ship according to claim 36 in which the hull has a double bottom and the second cargo space section is mounted to the double bottom, and the first cargo space section is above the second cargo space section and extends the entire breadth of the ship.

39. A cargo ship according to claim 36 in which the ship has a stern and a bowpeak bulkhead substantially opposite the stern, and in which the first cargo space section extends approximately from the stern to the bowpeak bulkhead.

* * * * *

UNITED STATES PATENT AND TRADEMARK OFFICE

CERTIFICATE OF CORRECTION

PATENT NO. : 6,105,525
DATED : August 22, 2000
INVENTOR(S) : Pekka E. Rapeli

It is certified that error appears in the above-identified patent and that said Letters Patent is hereby corrected as shown below:

Column 15,
Line 32, "cells 10," should read -- cells 110, --.

Column 19,
Lines 54-55,
"deck.
It is technically" should read -- deck. It is technically --.

Signed and Sealed this

Eighteenth Day of December, 2001

*Attest:*

*Attesting Officer*

JAMES E. ROGAN
*Director of the United States Patent and Trademark Office*